US010777124B1

(12) United States Patent
Chen et al.

(10) Patent No.: US 10,777,124 B1
(45) Date of Patent: Sep. 15, 2020

(54) LIGHT-EMITTING DEVICE DRIVING CIRCUIT

(71) Applicant: MIKRO MESA TECHNOLOGY CO., LTD., Apia (WS)

(72) Inventors: Shyh-Feng Chen, Hsinchu County (TW); Li-yi Chen, Tainan (TW)

(73) Assignee: MIKRO MESA TECHNOLOGY CO., LTD., Apia (WS)

( * ) Notice: Subject to any disclaimer, the term of this patent is extended or adjusted under 35 U.S.C. 154(b) by 0 days.

(21) Appl. No.: 16/299,155

(22) Filed: Mar. 12, 2019

(51) Int. Cl.
*G09G 3/32* (2016.01)

(52) U.S. Cl.
CPC ..... *G09G 3/32* (2013.01); *G09G 2300/043* (2013.01); *G09G 2300/0426* (2013.01); *G09G 2310/0267* (2013.01); *G09G 2310/0275* (2013.01)

(58) Field of Classification Search
CPC ..... G09G 3/32; G09G 2300/0426; G09G 2300/043; G09G 2310/0267; G09G 2310/0275
See application file for complete search history.

(56) References Cited

U.S. PATENT DOCUMENTS

2009/0096725 A1* 4/2009 Kretz ..... G09G 3/3233 345/82
2013/0038588 A1* 2/2013 Ono ..... G09G 3/3225 345/211
2015/0154906 A1* 6/2015 Chung ..... G09G 3/3291 345/212
2017/0116918 A1* 4/2017 Dong ..... G09G 3/20

* cited by examiner

*Primary Examiner* — Alexander Eisen
*Assistant Examiner* — Nathaniel P Brittingham
(74) *Attorney, Agent, or Firm* — CKC & Partners Co., LLC

(57) ABSTRACT

A light-emitting device driving circuit including a light emitting device, a delivery capacitor, a driving transistor, a reset circuit, a compensation circuit, and a data circuit is provided. The delivery capacitor is electrically connected to a low-level voltage. The driving transistor is configured to drive the light-emitting device according to a driving voltage received from a driving voltage line higher than that of the low-level voltage. The reset circuit is configured to determine whether to electrically connect the light-emitting device to the first node. The compensation is configured to receive a reference voltage higher than the low-level voltage to control a gate voltage of the driving transistor through a second node. The data circuit is configured to receive a data voltage to determine whether to electrically connect the data voltage to the compensation circuit and whether to electrically connect the data voltage to the delivery capacitor.

15 Claims, 24 Drawing Sheets

1000-1

200

300

200'

LIGHT-EMITTING DEVICE DRIVING CIRCUIT

BACKGROUND

Field of Invention

The present disclosure relates to a light-emitting device driving circuit for compensating a threshold voltage shift of a driving transistor therein.

Description of Related Art

The statements in this section merely provide background information related to the present disclosure and do not necessarily constitute prior art.

In recent years, different types of displays such as a thin film transistor liquid crystal display (TFT-LCD) and a thin film transistor organic light-emitting display (TFT-OLED) become more common and available. Some types of novel displays also being actively investigated with research and development resources, such as a mini light-emitting diode (mini-LED) display and a micro light-emitting diode (μ-LED) display. Conventional circuits for driving pixels in these displays encounter a problem on a threshold voltage shift of a driving transistor for driving a light-emitting device in the circuits.

SUMMARY

According to some embodiments of the present disclosure, a light-emitting device driving circuit including a light emitting device, a delivery capacitor, a driving transistor, a reset circuit, a compensation circuit, and a data circuit is provided. The delivery capacitor is electrically connected to a low-level voltage. The driving transistor is configured to drive the light-emitting device according to a driving voltage. The driving voltage is received from a driving voltage line in which a voltage level thereof is higher than that of the low-level voltage. The reset circuit is electrically connected to the driving transistor through a first node and is electrically connected to the light-emitting diode. The reset circuit is configured to determine whether to allow a current to flow from the first node to the low-level voltage through the light-emitting device. The compensation circuit is electrically connected to the first node and the delivery capacitor. The compensation circuit is configured to receive a reference voltage which is higher than the low-level voltage and to control a gate voltage of the driving transistor through a second node. The data circuit is configured to receive a data voltage and to determine whether to electrically connect the data voltage to the compensation circuit and whether to electrically connect the data voltage to the delivery capacitor.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
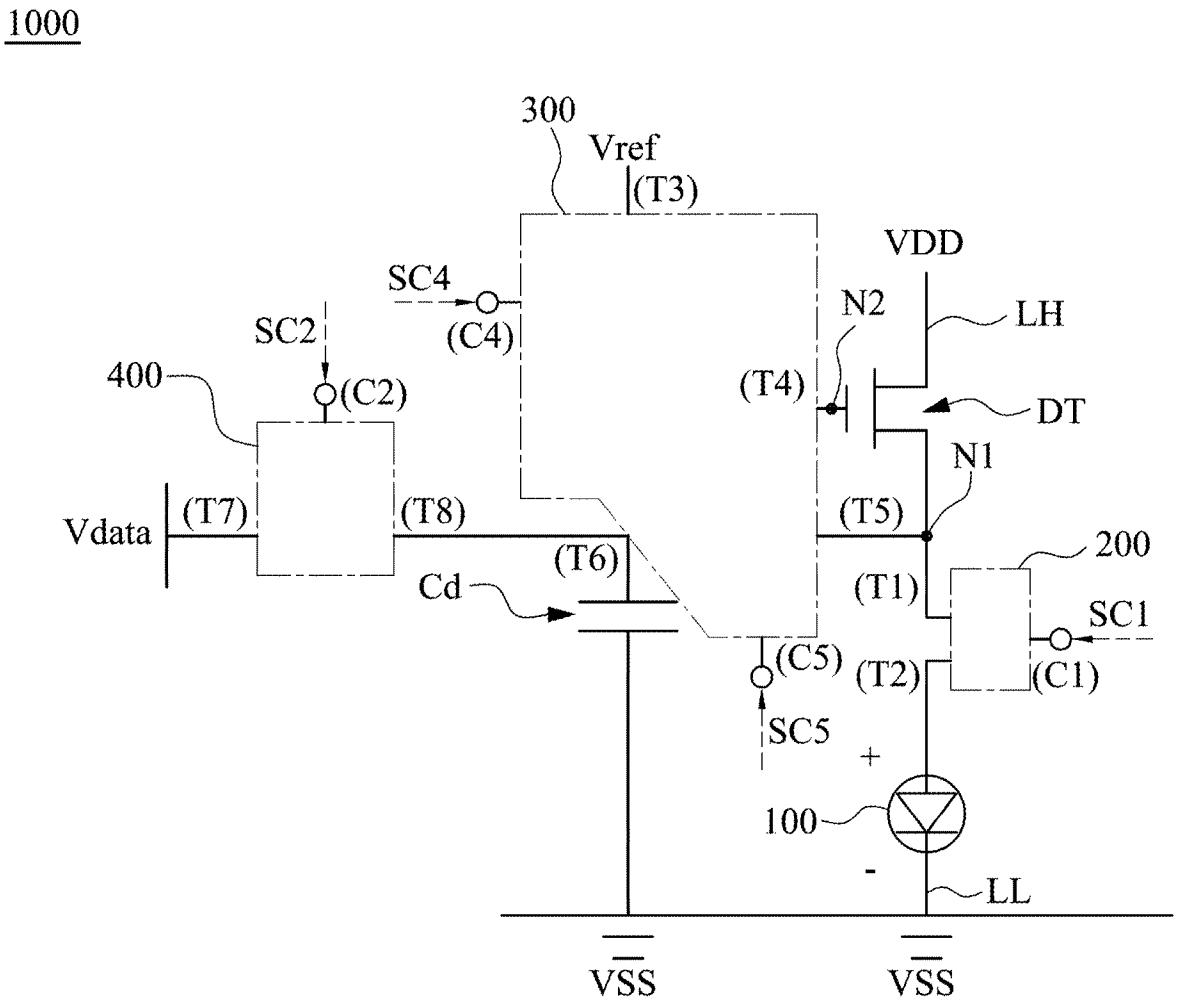
FIG. 1 is a schematic diagram of a light-emitting device driving circuit according to some embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

In various embodiments, description is made with reference to figures. However, certain embodiments may be practiced without one or more of these specific details, or in combination with other known methods and configurations. In the following description, numerous specific details are set forth, such as specific configurations, dimensions, and processes, etc., in order to provide a thorough understanding of the present disclosure. In other instances, well-known semiconductor processes and manufacturing techniques have not been described in particular detail in order to not unnecessarily obscure the present disclosure. Reference throughout this specification to "one embodiment," "an embodiment", "some embodiments" or the like means that a particular feature, structure, configuration, or characteristic described in connection with the embodiment is included in at least one embodiment of the disclosure. Thus, the appearances of the phrase "in one embodiment," "in an embodiment", "according to some embodiments" or the like in various places throughout this specification are not necessarily referring to the same embodiment of the disclosure. Furthermore, the particular features, structures, configurations, or characteristics may be combined in any suitable manner in one or more embodiments. Although most of terms described in the following disclosure use singular nouns, said terms may also be plural in accordance with figures or practical applications.

Reference is made to FIG. 1. FIG. 1 is a schematic diagram of a light-emitting device driving circuit 1000 according to some embodiments of the present disclosure. In some embodiments, a light-emitting device driving circuit 1000 including a light emitting device 100, a delivery capacitor Cd, a driving transistor DT, a reset circuit 200, a compensation circuit 300, and a data circuit 400 is provided. The delivery capacitor Cd is electrically connected to a low-level voltage VSS. The driving transistor DT is configured to drive the light-emitting device 100 according to a driving voltage VDD. The driving voltage VDD is received by a driving voltage line LH and is electrically connected to the driving transistor DT. A voltage level of the driving voltage VDD is higher than a voltage level of the low-level voltage VSS. The low-level voltage VSS can be a ground level voltage, but should not be limited thereto. The driving voltage VDD can be provided by a power source circuit and will not be described herein in detail. The reset circuit 200 is electrically connected to the driving transistor DT through a first node N1. The reset circuit 200 is also electrically connected to the light-emitting device 100. The reset circuit 200 is configured to determine whether to electrically connect the light-emitting device 100 to the first node N1. The compensation circuit 300 is electrically connected to the first node N1 and the delivery capacitor Cd. The compensation circuit 300 is configured to receive a reference voltage Vref and to control a gate voltage of the driving transistor DT through a second node N2. A voltage level of the reference voltage Vref is higher than the voltage level of the low-level voltage VSS. In some embodiments, the reference voltage Vref and the driving voltage VDD can have the same voltage level (e.g., the driving voltage VDD is applied to the compensation circuit 300). The data circuit 400 is configured to receive a data voltage Vdata and to determine whether to electrically connect the data voltage Vdata to the compensation circuit 300 and whether to electrically connect the data voltage Vdata to the delivery capacitor Cd.

Although the "electrically connected" as interpreted in figures of the present disclosure is mainly for "direct connected, however, some minor electronic components (e.g., resistors) which do not affect operations and result as disclosed in the embodiments of the present disclosure can be present between two electrically connected components. They can be incorporated into the scope of the present disclosure.

In some embodiments, the reset circuit 200 includes two terminals T1 and T2 and a control terminal C1, but should not be limited thereto. In some embodiments, the compensation circuit 300 includes four terminals T3, T4, T5, and T6 and two control terminals C4 and C5, but should not be limited thereto. In some embodiments, the data circuit 400 includes two terminals T7 and T8 and a control terminal C2, but should not be limited thereto.

Reference is made to the reset circuit 200 as shown in FIG. 1. The terminal T1 is electrically connected to a source terminal of the driving transistor DT through a first node N1. The terminal T2 is electrically connected to the low-level voltage VSS via the light-emitting device 100. The reset circuit 200 is electrically connected to the light-emitting device 100 in series between the driving transistor DT and the low-level voltage line LL. The determination of whether to electrically connect the first node N1 to the light-emitting device 100 is in accordance with a scan signal SC1 received by the control terminal C1. When the light-emitting device 100 and the driving transistor DT are electrically connected, they are electrically connected through the reset circuit 200.

Reference is made to the compensation circuit 300 as shown in FIG. 1. The terminal T3 is configured to receive the reference voltage Vref. The terminal T4 is electrically connected to the driving transistor DT and is used to control a gate voltage of the driving transistor DT. The terminal T5 is electrically connected to the reset circuit 200 through the first node (N1). The terminal T6 is electrically connected to one end of the delivery capacitor Cd different from another end of the delivery capacitor Cd which is electrically connected to the low-level voltage VSS. The compensation circuit 300 is configured to determine whether to receive the reference voltage Vref in accordance with a scan signal SC4 received by the control terminal C4. The compensation circuit 300 is configured to determine whether to electrically connect the data circuit 400 and the delivery capacitor Cd to the first node N1 in accordance with a scan signal SC5 received by the control terminal C5.

Reference is made to the data circuit 400 as shown in FIG. 1. The terminal T8 is electrically connected (e.g., directly connected, but should not be limited thereto) to the terminal T6 of the compensation circuit 300. The determination of whether to electrically connect the data voltage Vdata to the compensation circuit 300 and whether to electrically connect the data voltage Vdata to the delivery capacitor Cd is in accordance with a scan signal SC2 received by the control terminal C2.

Reference is made to FIG. 1 and FIGS. 2A to 2E. FIGS. 2A to 2E are timing diagrams of operations for the light-emitting device driving circuit 1000 according to some embodiments of the present disclosure. The light-emitting device driving circuit 1000 is operated in a pre-emission time segment PETS and an emission time segment ES. The pre-emission time segment PETS does not overlap with the emission time segment ES. In some embodiments, the pre-emission time segment PETS includes a combination of a blank segment BS, a reset segment RS, a compensation segment CS, and a data input segment DIS (as referred to FIG. 2A). In some embodiments, the pre-emission time segment PETS includes a combination of the reset segment RS, the compensation segment CS, and the data input segment DIS. In some embodiments, the pre-emission time segment PETS includes a combination of a recovery segment RCS, the reset segment RS, the compensation segment CS, and a data input segment DIS (as referred to FIGS. 2B and 2C). In some embodiments, the pre-emission time segment PETS includes a combination of the recovery segment RCS, the blank segment BS, and the data input segment DIS (as referred to FIG. 2D). In some embodiments, the pre-emission time segment PETS includes a combination of the blank segment BS, the recovery segment RCS, the reset segment RS, the compensation segment CS, and the data input segment DIS. In some embodiments, the pre-emission time segment PETS includes a combination of the blank segment BS and the data input segment DIS (as referred to FIG. 2E). In some embodiments, the reset segment RS, the compensation segment CS, and the data input segment DIS are operated in sequence. Some of these different ways of operation are shown in FIGS. 2A to 2E as exemplifications.

Figure 2A:
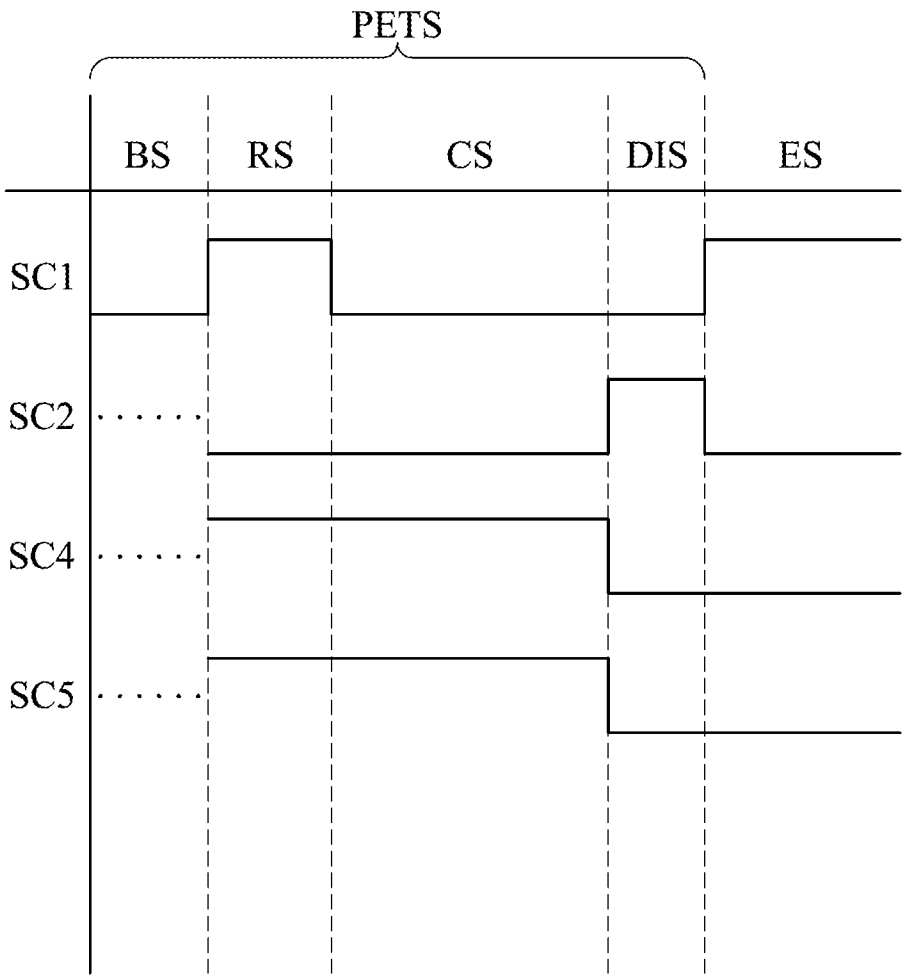
FIG. 2A is a timing diagram of an operation for the light-emitting device driving circuit according to some embodiments of the present disclosure.

Reference is made to FIG. 2A, in which the light-emitting device driving circuit 1000 is operated in the pre-emission time segment PETS and the emission time segment ES, and the pre-emission time segment PETS includes the combination of the blank segment BS, the reset segment RS, the compensation segment CS, and the data input segment DIS.

An operation during the reset segment RS is as follows. The data circuit 400 is disabled and the reset circuit 200 and the compensation circuit 300 are enabled, such that the data voltage Vdata is disallowed to be applied to the driving transistor DT and a voltage difference between the second node N2 and the first node N1 is greater than a threshold voltage Vth of the driving transistor DT. Specifically, the scan signal SC4 is applied to the control terminal C4 of the compensation circuit 300 to enable a control of the gate voltage of the driving transistor DT by the reference voltage Vref. More precisely, the reference voltage Vref is applied to the driving transistor DT via the terminals T3 and T4 of the compensation circuit 300. A voltage level of the reference voltage Vref is higher than a sum of voltage levels of a threshold voltage Vth of the driving transistor DT and the low-level voltage VSS so as to enable the driving transistor DT. Therefore, the driving voltage VDD is applied to drive a current to flow from the driving voltage line LH to a low-level voltage line LL via the first node N1. As a result, a voltage difference between the second node N2 and the first node N1 is increased and a voltage difference between the first node N1 and the low-level voltage VSS becomes a voltage difference between two ends of the light-emitting device 100. The dotted points present in some of the segments as illustrated in all of the timing diagrams means that a state of "enable" or "disable" is irrelevant during the segment under consideration. For example, the state of the scan signals SC2, SC4, and SC5 are irrelevant during the blank segment BS, and only the scan signal SC1 is applied to disable the reset circuit 200 during the blank segment BS in the embodiments as illustrated by FIG. 2A.

The "enabled" and "disabled" described in the present disclosure are explained as follows. The reset circuit 200 is enabled (disabled) when a current is allowed (disallowed) to flow through the reset circuit 200. The compensation circuit 300 is enabled when currents are allowed to flow through the terminals T3 and T6 and currents are allowed to flow through the terminals T4 and T5. The compensation circuit 300 is disabled when a current is disallowed to flow through the terminal T3 and a current is disallowed to flow through the terminal T5. In the reset segment RS, the terminal T5 of the compensation circuit 300 can be optionally chosen to disallow a current to flow through thereof. A current is allowed to flow through the terminal T6 when the compensation circuit 300 is disabled, and a current is allowed to flow through the terminal T4 when the compensation circuit 300 is disabled. The data circuit 400 is enabled (disabled) when a current is allowed (disallowed) to flow through the terminal T7 and through the terminal T8.

After the reset segment RS, the operation continues to the compensation segment CS. The operation during the compensation segment CS is as follows. The data circuit 400 and the reset circuit 200 are disabled and the compensation circuit 300 is enabled, such that a voltage level of the first node N1 is gradually increased until a voltage difference between the second node N2 and the first node (N1) approaches the threshold voltage Vth of the driving transistor DT. That is, a gate-to-source voltage Vgs is substantially equal to the threshold voltage Vth of the driving transistor DT. Specifically, the voltage level of the first node N1 is increased since a current flowing from the driving voltage line LH is disallowed to flow to the low-level voltage line LL, and the first node N1 is substantially floated and electrically isolated from the low-level voltage VSS. Instead, the current flows to the terminal T5 of the compensation circuit 300 via the first node N1, such that the floated first node N1 is gradually charged to increase the voltage level of the first node N1 until there is not enough electrical potential to drive said current, which is a moment when the gate-to-source voltage Vgs is substantially equal to the threshold voltage Vth of the driving transistor DT. A voltage difference substantially (acceptably) equal to the threshold voltage Vth of the driving transistor DT is thus stored in an electronic component (e.g., a capacitor, or the like) of the compensation circuit 300. The term "substantially equal to" or "acceptably equal to" means close to a designated value (e.g., close to the threshold voltage) such that one can regard it as the designated value.

After the compensation segment CS, the operation continues to the data input segment DIS. The operation during the data input segment DIS is as follows. The reset circuit 200 and the compensation circuit 300 are disabled and the data circuit 400 is enabled, such that the data voltage Vdata and the threshold voltage Vth of the driving transistor DT stored in electronic components (e.g., capacitors, or the like) of the compensation circuit 300 are combined and applied to the driving transistor DT through the delivery capacitor Cd and the compensation circuit 300. Specifically, the data voltage Vdata is applied to the terminal T6 of the compensation circuit 300, and the data voltage Vdata plus the threshold voltage Vth are combined by the compensation circuit (300) to control the gate voltage of the driving transistor DT in the next coming emission segment ES. As a result, the threshold voltage Vth of the driving circuit DT is substantially compensated.

After the data input segment DIS, the operation continues to the emission segment ES. The operation during the emission segment ES is as follows. The data circuit 400 and the compensation circuit 300 are disabled and the reset circuit 200 is enabled, such that the light-emitting device 100 is driven according to the driving voltage VDD and the gate voltage (which is equal to the data voltage Vdata plus the threshold voltage Vth of the driving transistor DT stored in electronic components (e.g., capacitors, or the like) of the compensation circuit 300) applied to the driving transistor DT via the compensation circuit 300.

With the light-emitting device driving circuit 1000 and the operations described above, a threshold voltage shift of the driving transistor DT can be compensated and will not affect an emission current Id of the light-emitting device 100. Specifically, after the operation of the data input segment DIS, the equation I: Vdata+Vth=Vgs+Von is satisfied, in which Von is a voltage difference between two ends of the light-emitting device 100 when the light-emitting device 100 is turned on with the emission current Id flowing through thereof driven by the driving transistor DT. A voltage sum of "Vdata+Vth" on the left-hand side of the equation I is measured between the second node N2 and the low-level voltage VSS which is electrically connected to one end of the delivery capacitor Cd. A voltage sum of "Vgs+Von" on the right-hand side of the equation I is measured between the second node N2 and the low-level voltage VSS which is electrically connected to one end of the light-emitting device 100. Using the equation I, the emission current Id during the emission segment ES can be obtained by an algebra in the equation II: $Id=K*(Vgs-Vth)^2=K*(Vdata+Vth-Von-Vth)^2=K*(Vdata-Von)^2$, which is independent of Vth, and K is a constant value related to properties of the driving transistor DT. The equation II is an exemplification under a first-order approximation which omits higher-order terms and under an assumption that the driving transistor DT is operated in the saturation region. However, the emission current Id and the threshold voltage Vth are also independent from each other when the driving transistors are operated in a linear region.

Another advantage of the light-emitting device driving circuit 1000 and the operations described above is to enhance a precision of controlling brightness, which is particularly useful in a low grayscale region of the light-emitting device 100. Specifically, the emission current Id of the light-emitting device 100 is proportional to a voltage difference between two ends of the light-emitting device 100 (i.e., Von), and a drain-to-source current of the driving transistor DT (e.g., the thin film transistor in the present embodiments) is proportional to the gate-to-source voltage Vgs under a configuration of the light-emitting device driving circuit 1000. As such, there are two voltage parameters: the voltage difference between two ends of the light-emitting device 100 (i.e., Von) and the gate-to-source voltage Vgs of the driving transistor DT) which can be used to control the brightness of the light-emitting device 100, and these two voltage parameters (i.e., Von and Vgs) can be controlled by one voltage parameter Vdata according to the equation I: Vdata+Vth=Vgs+Von, derived above. Therefore, a data voltage difference ΔVdata corresponding to a given emission current difference ΔId in the above embodiments is greater than a gate-to-source voltage difference ΔVgs corresponding to said given emission current difference ΔId in conventional circuits, which substantially increases the precision of said control.

Yet another advantage of the light-emitting device driving circuit 1000 and the operations described above is that since the data circuit 400 is only enabled by the scan signal SC2 during the data input segment DIS, the data voltage Vdata can be used to drive other pixels in other scan lines during the reset segment RS and the compensation segment CS of the pixel under consideration of the present embodiments, which greatly enhances a resolution, so that the data voltage Vdata is only occupied by one scan line time (i.e. only occupied by the data input segment DIS) and can be used to drive high resolution display. The operations described above can substantially skip the duration for waiting the compensation segment CS, so as to be more suitable to drive a high resolution display.

Figure 2B:
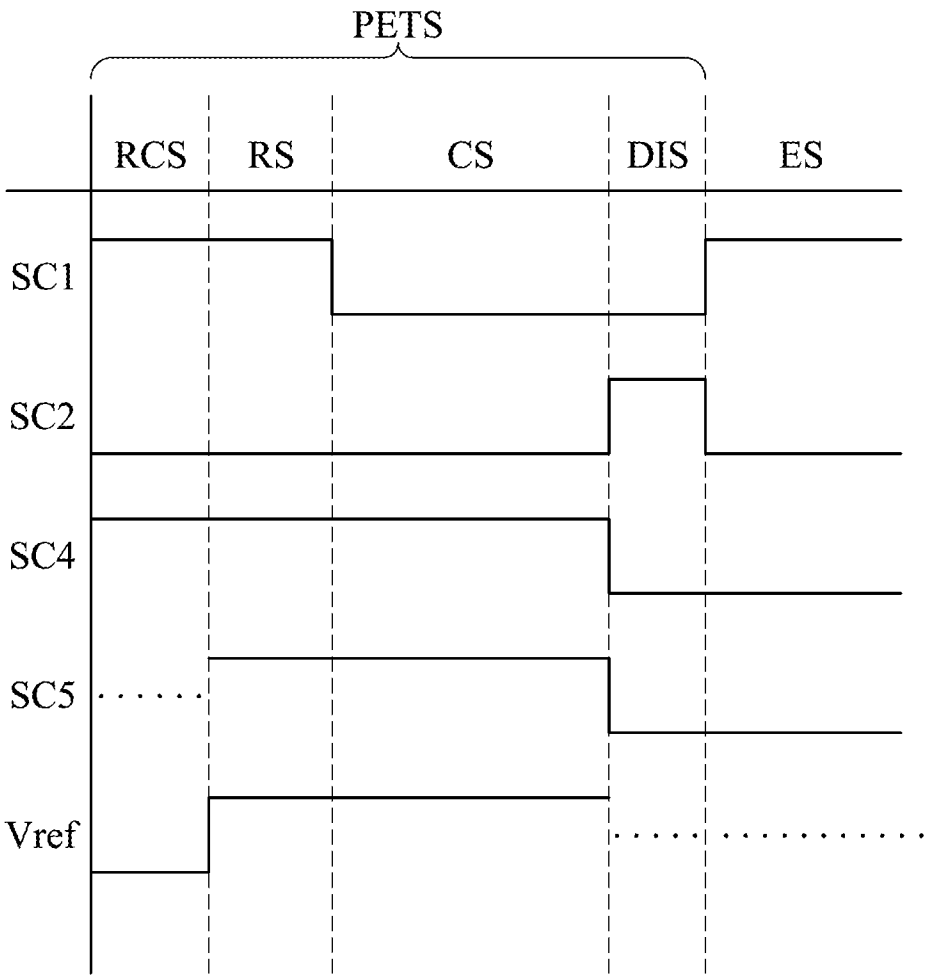
FIG. 2B is a timing diagram of an operation for the light-emitting device driving circuit according to some embodiments of the present disclosure.

Reference is made to FIG. 2B. The difference between embodiments as shown in FIG. 2B and the embodiments as shown in FIG. 2A is that the blank segment BS in the embodiments illustrated by FIG. 2A is replaced by the recovery segment RCS in the embodiments illustrated FIG. 2B. In some embodiments, a combination of enablement and disablement of the reset circuit 200, the compensation circuit 300, and the data circuit 400 of the recovery segment RCS can be the same as that during the reset segment RS. The difference between the recovery segment RCS and the reset segment RS is that the voltage level of the reference voltage Vref applied during the reset segment RS is higher than a sum of the voltage levels of the threshold voltage Vth of the driving transistor DT, the low-level voltage VSS, and a voltage difference between two ends of the light-emitting device 100, whereas a voltage level of the reference voltage Vref applied during the recovery segment RCS is lower than the sum of the voltage levels of the threshold voltage Vth of the driving transistor DT, the low-level voltage VSS, and the voltage difference between two ends of the light-emitting device 100. Therefore, the threshold voltage shift of the driving transistor DT due to the operation during the emission segment ES may have a certain degree of recovery during the recovery segment RCS.

Figure 2C:
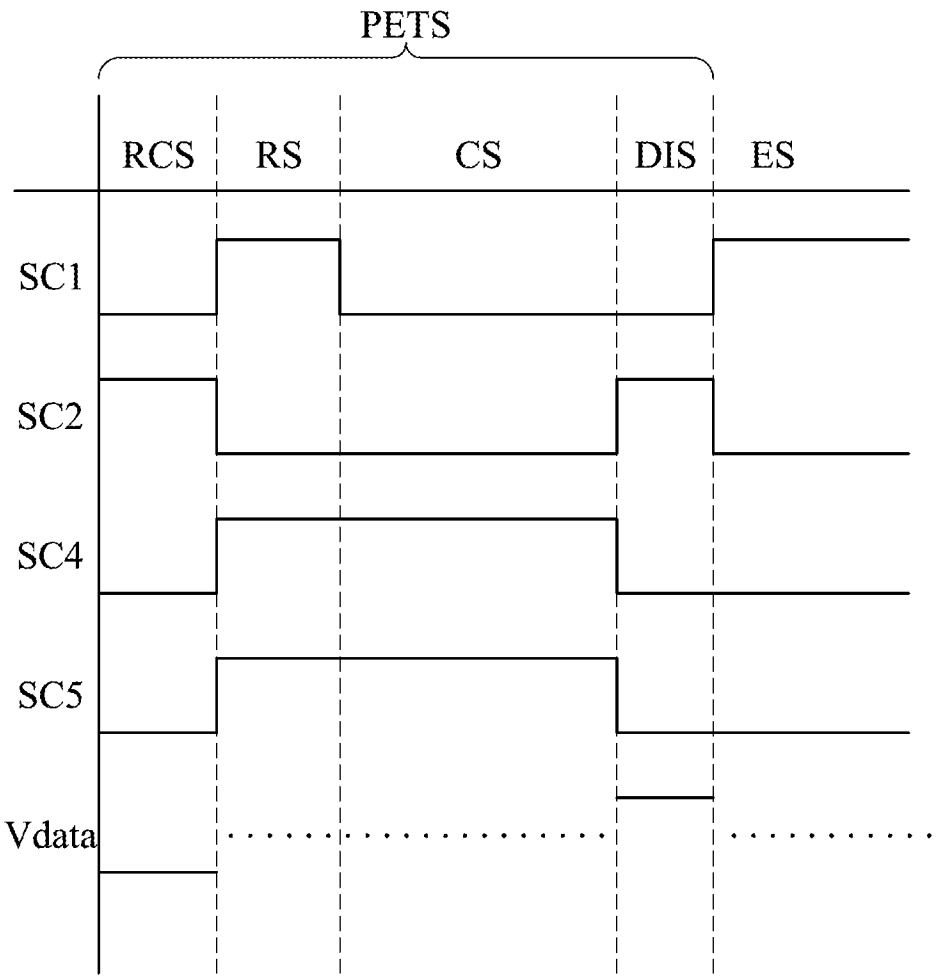
FIG. 2C is a timing diagram of an operation for the light-emitting device driving circuit according to some embodiments of the present disclosure.

Reference is made to FIG. 2C. The difference between embodiments as shown in FIG. 2C and the embodiments as shown in FIG. 2B is that the gate voltage of the driving transistor DT for said recovery is applied by the data voltage Vdata. A combination of enablement and disablement of the reset circuit 200, the compensation circuit 300, and the data circuit 400 during the recovery segment RCS in the embodiments illustrated by FIG. 2C can be the same as that during the data input segment DIS, except that a voltage level of the data voltage Vdata during the recovery segment RCS is lower than the sum of the voltage levels of the threshold voltage Vth of the driving transistor DT, the low-level voltage VSS, and the voltage difference between two ends of the light-emitting device 100.

Figure 2D:
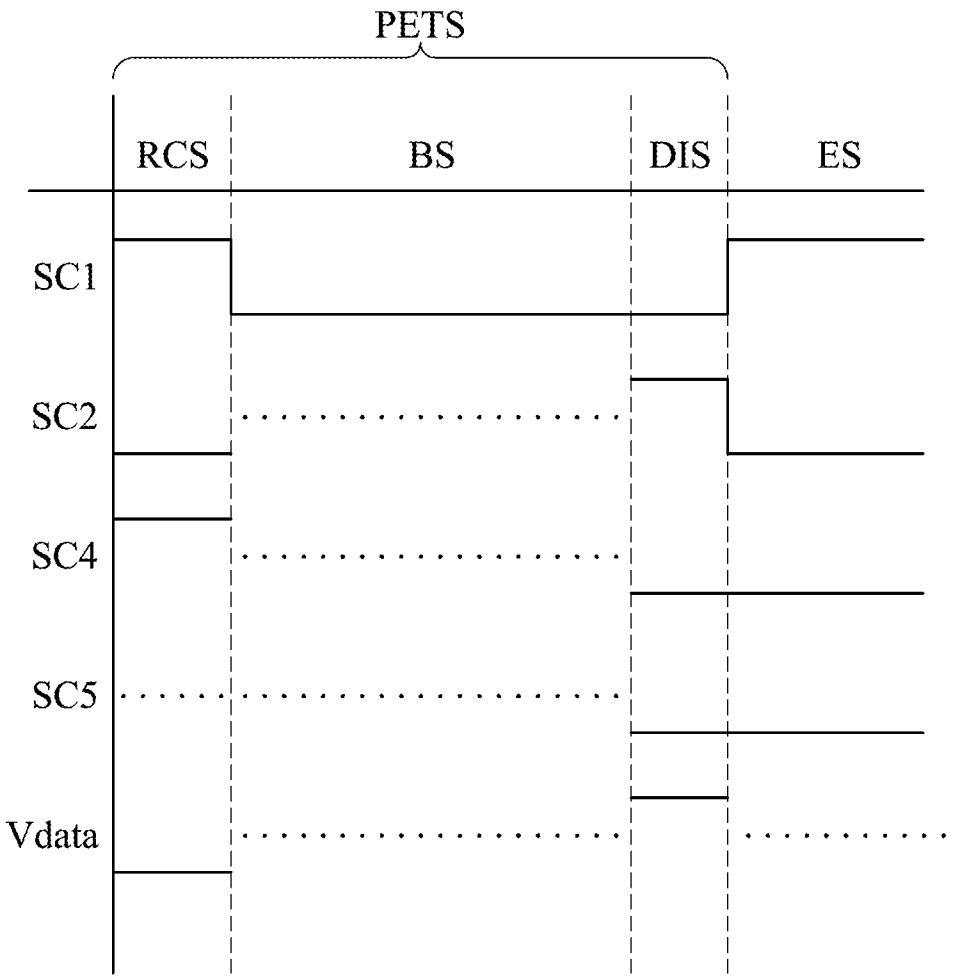
FIG. 2D is a timing diagram of an operation for the light-emitting device driving circuit according to some embodiments of the present disclosure.

Reference is made to FIG. 2D. The difference between embodiments as shown in FIG. 2D and the embodiments as shown in FIG. 2C is that the pre-emission time segment PETS in FIG. 2D includes only the recovery segment RCS, the blank segment BS, and the data input segment DIS. The reset segment RS and the compensation segment CS are not included in the pre-emission time segment PETS. It can be understood that not every frame needs compensation within one pixel.

Figure 2E:
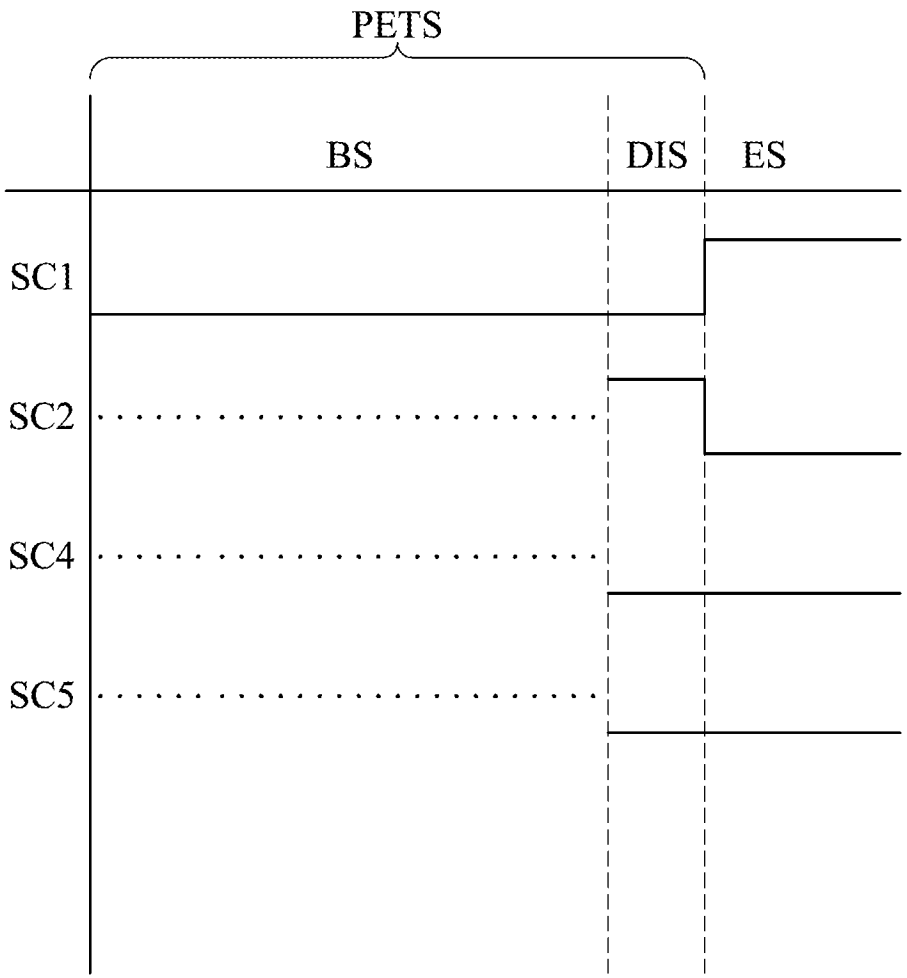
FIG. 2E is a timing diagram of an operation for the light-emitting device driving circuit according to some embodiments of the present disclosure.

Reference is made to FIG. 2E. In some embodiments, the pre-emission time segment PETS only includes the blank segment BS and the data input segment DIS, in which the compensation circuit 300 and the data circuit 400 can be kept in states the same as those at the end of the previous operation, no matter they are enabled or disabled, while the reset circuit 200 is disabled.

Figure 2F:
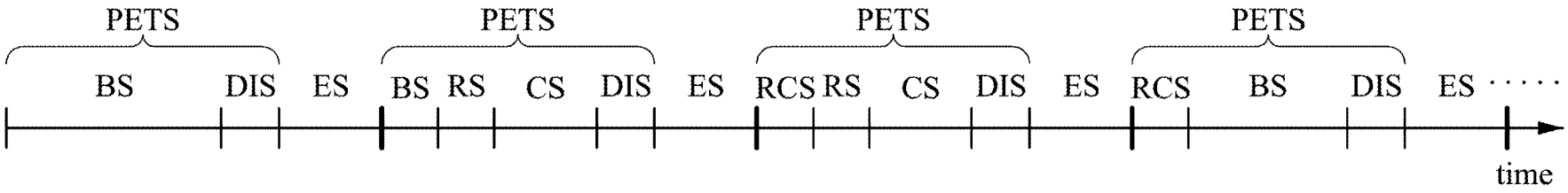
FIG. 2F is a timing diagram of a combination of operations for the light-emitting device driving circuit according to some embodiments of the present disclosure.

Reference is made to FIG. 2F. FIG. 2F is a timing diagram of a combination of operations for the light-emitting device driving circuit 1000 according to some embodiments of the present disclosure. Embodiments illustrated by FIG. 2F exemplifies a combination of four pre-emission time segments PETS and four emission time segments ES operated in sequence. The first pre-emission time segment PETS includes the blank segment BS and the data input segment DIS. The second pre-emission time segment PETS includes the blank segment BS, the reset segment RS, the compensation segment CS, and the data input segment DIS. The third pre-emission time segment PETS includes the recovery segment RCS, the reset segment RS, the compensation segment CS, and the data input segment DIS. The fourth pre-emission time segment PETS includes the recovery segment RCS, the blank segment BS, and the data input segment DIS. Although the embodiments illustrated by FIG. 2F only shows one example of the combination, it should not be limited thereto. Other embodiments with different type of combinations using the blank segment BS, the recovery segment RCS, the reset segment RS, the compensation segment CS, and the data input segment DIS are also within the scope of the present disclosure.

Figure 3A:
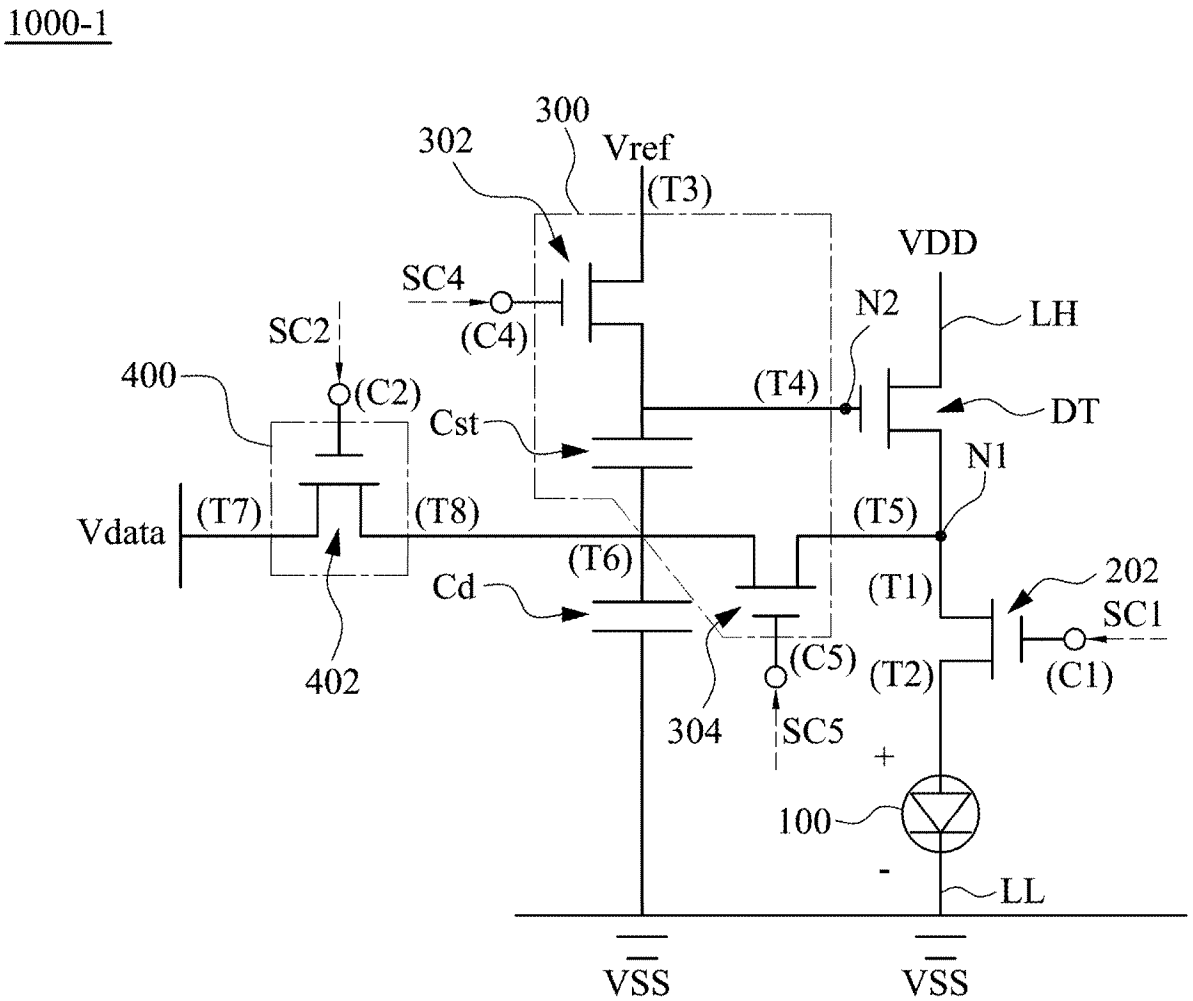
FIG. 3A is a schematic diagram of a light-emitting device driving circuit according to some embodiments of the present disclosure.
Figure 3B:
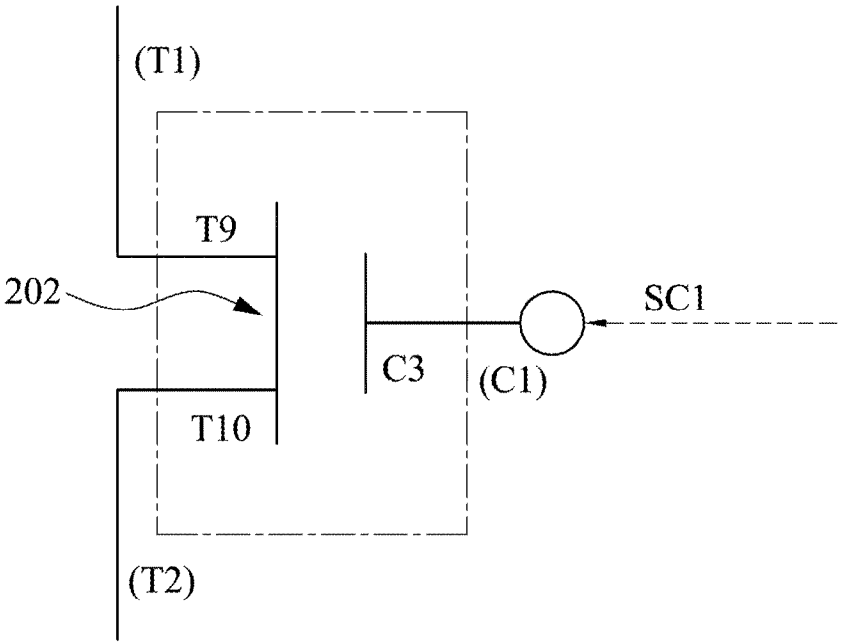
FIG. 3B is a schematic diagram of a reset circuit according to some embodiments of the present disclosure.
Figure 3C:
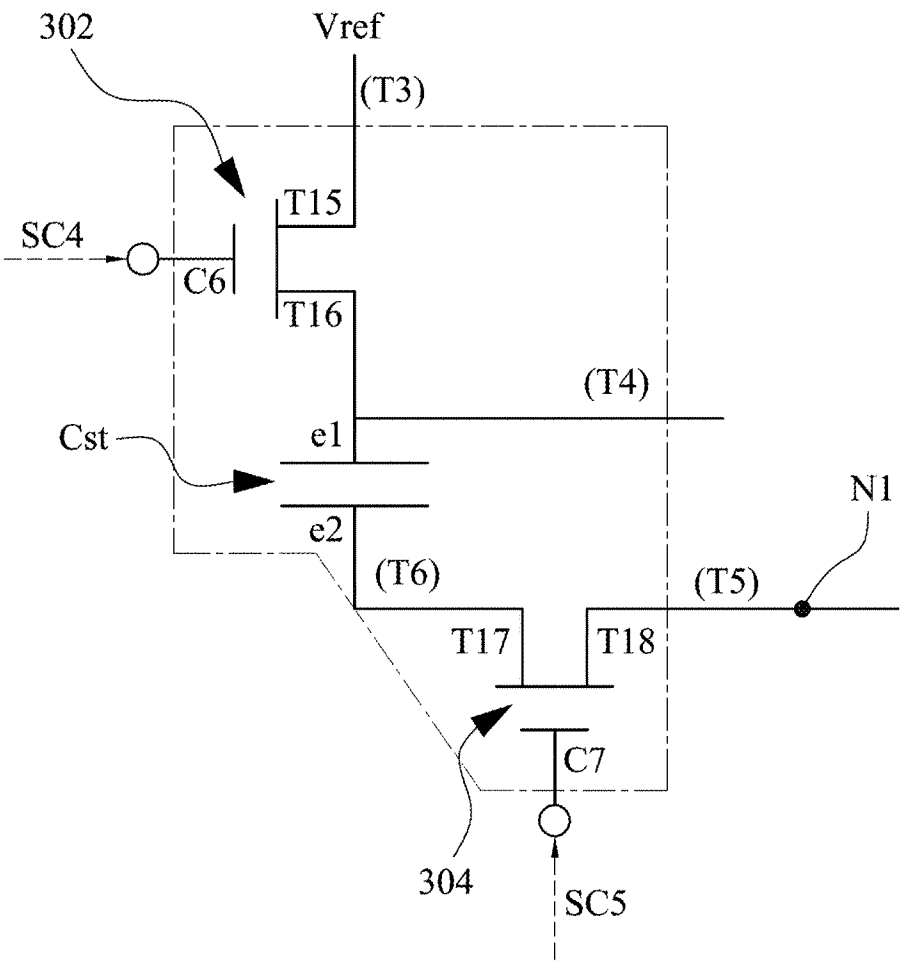
FIG. 3C is a schematic diagram of a compensation circuit according to some embodiments of the present disclosure.
Figure 3D:
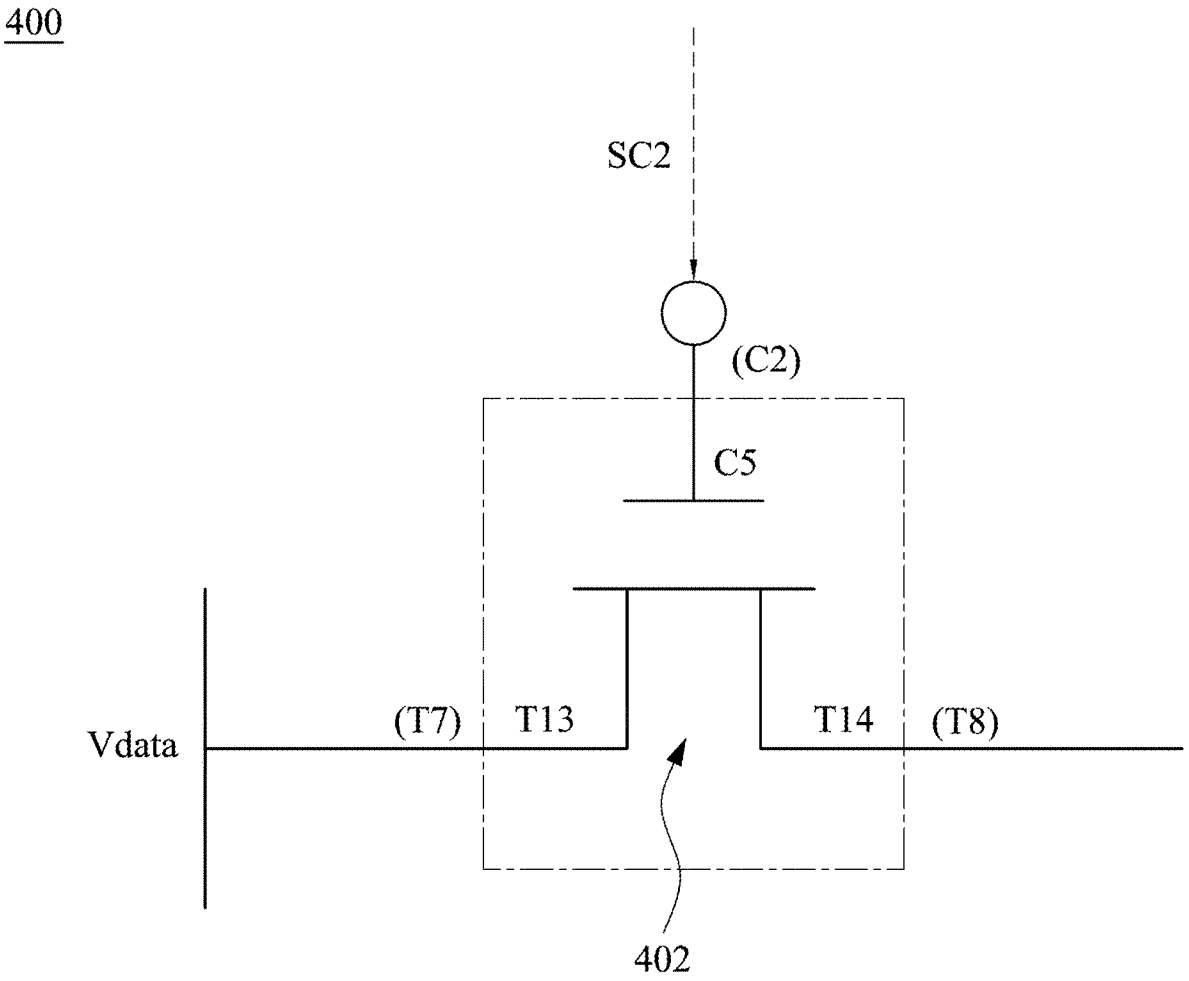
FIG. 3D is a schematic diagram of a data circuit according to some embodiments of the present disclosure.
Figure 4A:
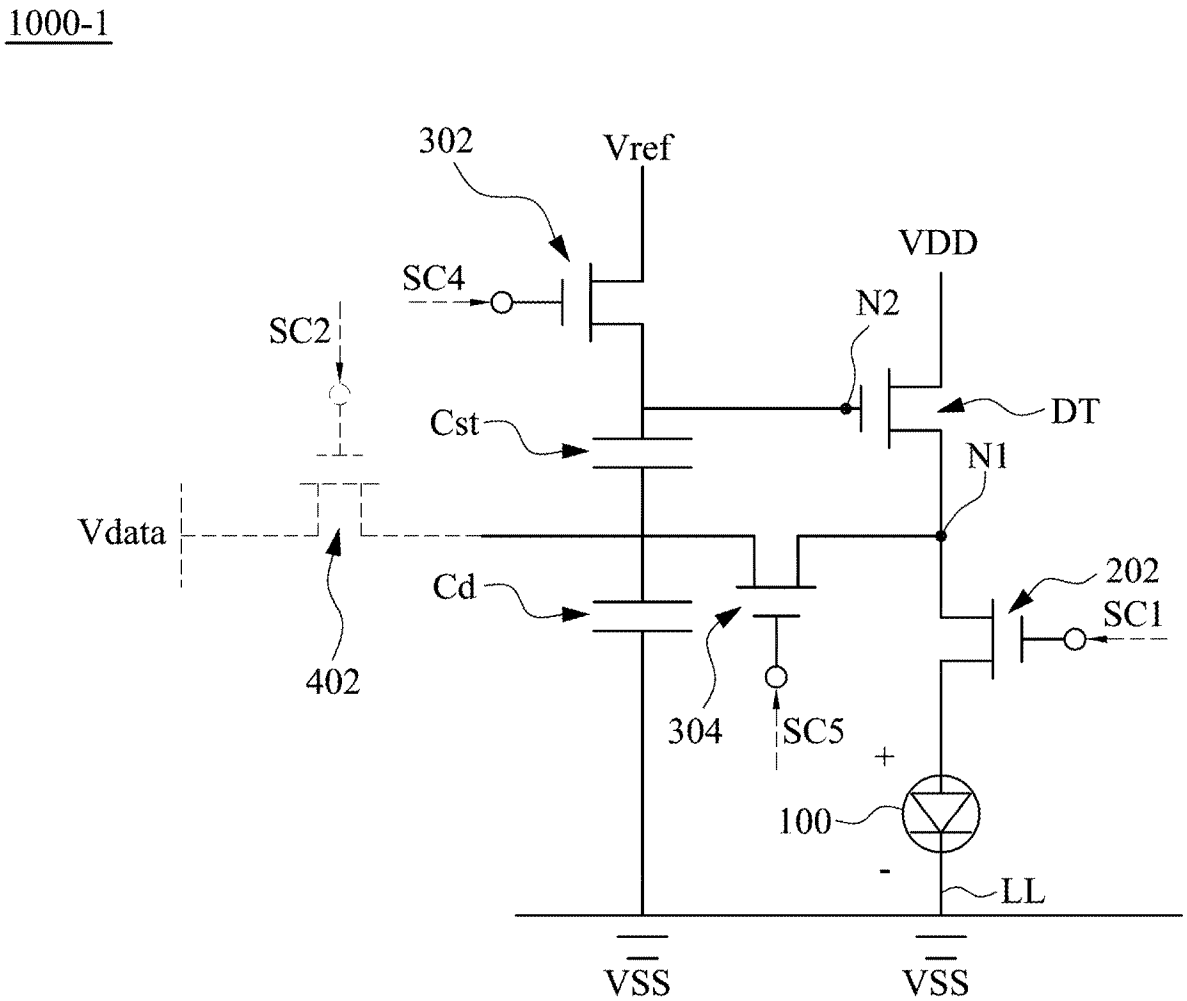
FIG. 4A is a light-emitting device driving circuit operated during the reset segment according to some embodiments of the present disclosure.
Figure 4B:
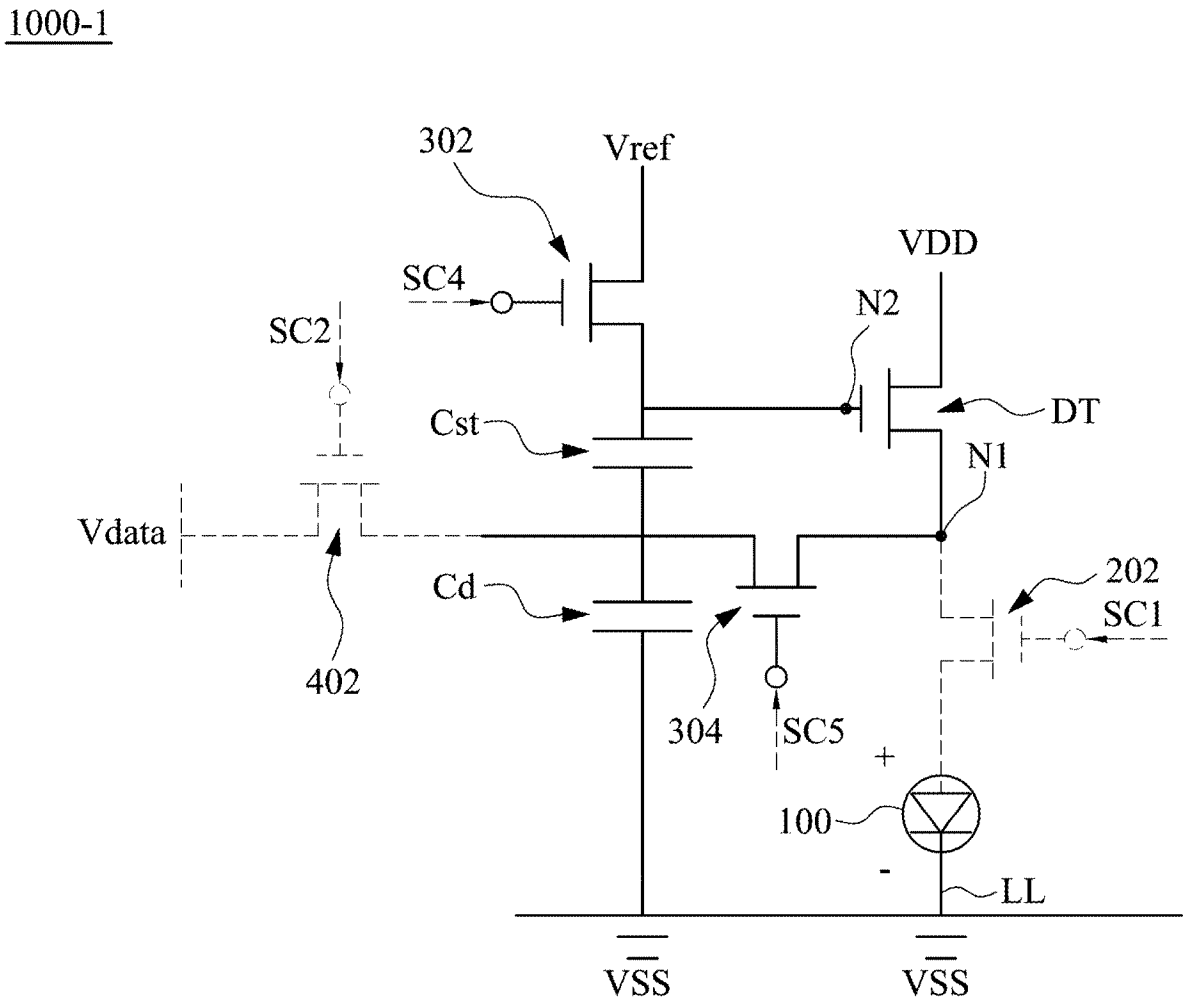
FIG. 4B is a light-emitting device driving circuit operated during the compensation segment according to some embodiments of the present disclosure.
Figure 4C:
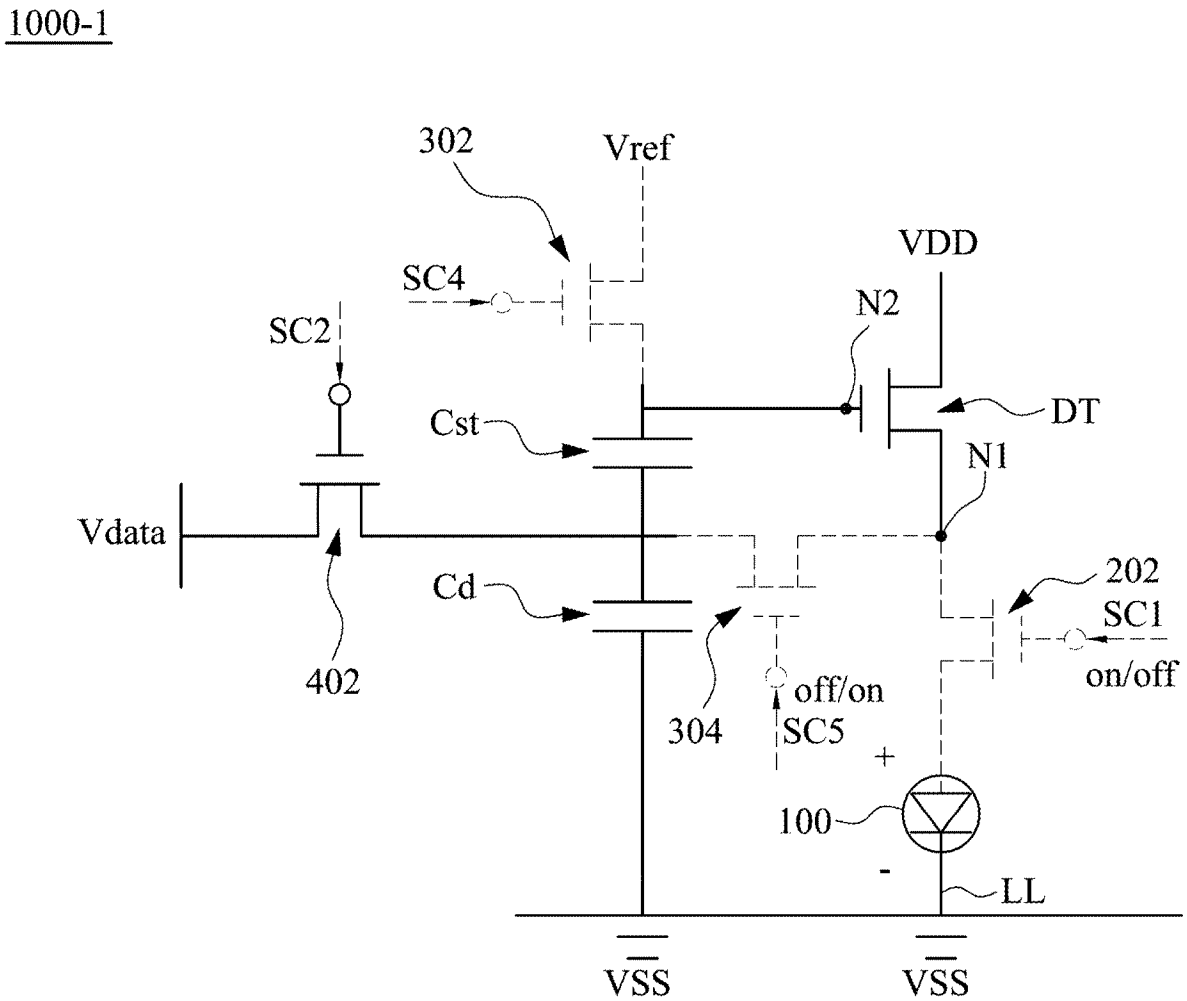
FIG. 4C is a light-emitting device driving circuit operated during the data input segment according to some embodiments of the present disclosure.
Figure 4D:
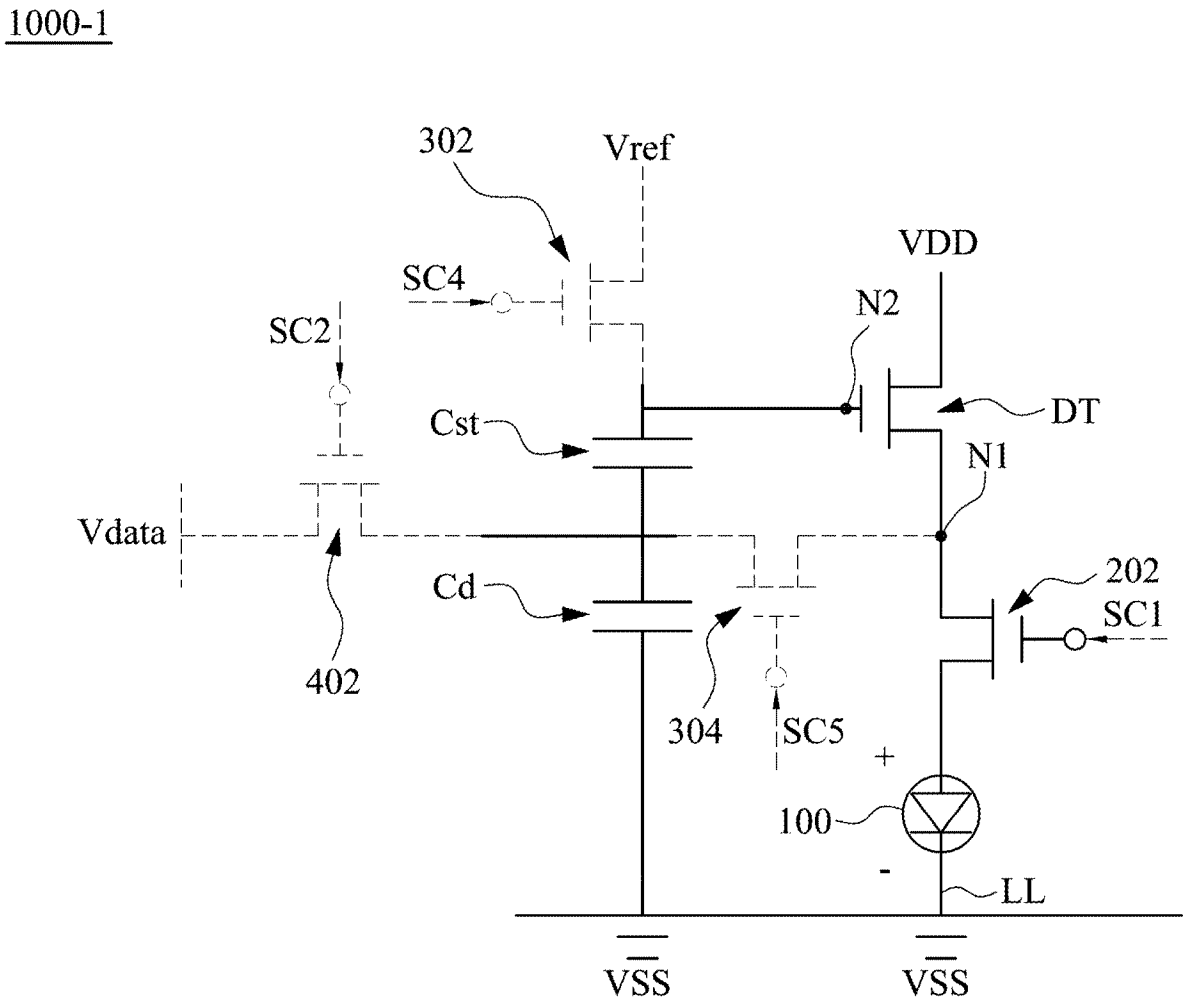
FIG. 4D is a light-emitting device driving circuit operated during the emission segment according to some embodiments of the present disclosure.

Reference is made to FIGS. 3A to 3D and FIGS. 4A to 4D. FIG. 3A is a schematic diagram of a light-emitting device driving circuit 1000-1 according to some embodiments of the present disclosure. FIG. 3B is a schematic diagram of a reset circuit 200 according to some embodiments of the present disclosure. FIG. 3C is a schematic diagram of a compensation circuit 300 according to some embodiments of the present disclosure. FIG. 3D is a schematic diagram of a data circuit 400 according to some embodiments of the present disclosure. FIG. 4A is a schematic diagram of the light-emitting device driving circuit 1000-1 operated during the reset segment RS according to some embodiments of the present disclosure. FIG. 4B is a schematic diagram of the light-emitting device driving circuit 1000-1 operated during the compensation segment CS according to some embodiments of the present disclosure. FIG. 4C is a schematic diagram of the light-emitting device driving circuit 1000-1 operated during the data input segment DIS according to some embodiments of the present disclosure. The word "on/off" for the scan signal SC1 and the word "off/on" for the scan signal SC5 means that besides the embodiments in which the switching transistor 202 and the switching transistor 304 are disabled, there are also other two permissible embodiments. The first embodiment is that the switching transistor 202 is enabled while the switching transistor 304 is disabled. The second embodiment is that the witching transistor 202 is disabled while the switching transistor 304 is enabled. FIG. 4D is a schematic diagram of the light-emitting device driving circuit 1000-1 operated during the emission segment ES according to some embodiments of the present disclosure. The dotted lines drawn for some of the switching transistors in FIGS. 4A to 4D represent disabled switching transistors, and solid lines drawn for some of the switching transistors in FIGS. 4A to 4D represent enabled switching transistors.

In some embodiments, the reset circuit 200 includes a switching transistor 202. The switching transistor 202 has terminals T9 and T10, and a control terminal C3 (referred to FIG. 3B). The terminal T9 is electrically connected to the driving transistor DT through the first node N1, and the second terminal T10 is electrically connected to the light-emitting device 100. The control terminal C3 is configured to receive the scan signal SC1. In some embodiments, the terminal T9 of the switching transistor 202 serves as the terminal T1 of the reset circuit 200, the terminal T10 of the switching transistor 202 serves as the terminal T2 of the reset circuit 200, and the control terminal C3 of the switching transistor 202 serves as the control terminal C1 of the reset circuit 200. During the reset segment RS and the emission segment ES, the switching transistor 202 is enabled by the scan signal SC1 to allow a current to flow from the first node N1 to the low-level voltage line LL through the light-emitting device 100. During the compensation segment CS, the switching transistor 202 is disabled by the scan signal SC1, and there is substantially no current flowing through the light-emitting device 100. During the recovery segment RCS which uses the reference voltage Vref to recover the threshold voltage shift of the driving transistor DT, the switching transistor 202 is enabled by the scan signal SC1, and during the recovery segment RCS which uses the data voltage Vdata to recover the threshold voltage shift of the driving transistor DT, the switching transistor 202 is also disabled by the scan signal SC1.

In some embodiments, the compensation circuit 300 includes a storage capacitor Cst, a switching transistor 302, and a switching transistor 304 (referred to FIG. 3C). The storage capacitor Cst has a first end e1 and a second end e2. The switching transistor 302 has terminals T15 and T16, and a control terminal C6. The terminal T15 is electrically connected to the reference voltage Vref. The terminal T16 is electrically connected to the first end e1 of the storage capacitor Cst and the second node N2. The control terminal C6 is configured receive the scan signal SC4. The switching transistor 304 has terminals T17 and T18 and a control terminal C7. The terminal T17 is electrically connected to the second end e2 of the storage capacitor Cst and one end of the delivery capacitor Cd which is different from the end of the delivery capacitor Cd electrically connected to the low-level voltage VSS. The terminal T18 is electrically connected to the first node N1. The control terminal C7 is configured to receive the scan signal SC5. In some embodiments, the terminal T15 of the switching transistor 302 serves as the terminal T3 of the compensation circuit 300, the terminal T16 of the switching transistor 302 and the first end e1 of the storage capacitor Cst serves as the terminal T4 of the compensation circuit 300, the terminal T18 of the switching transistor 304 serves as the terminal T5 of the compensation circuit 300, and the terminal T17 of the switching transistor 304 serves as the terminal T6 of the compensation circuit 300. During the reset segment RS and the compensation segment CS, the switching transistor 302 and the switching transistor 304 are enabled respectively by the scan signal SC4 and the scan signal SC5, such that the reference voltage Vref is applied to modulate the gate voltage of the driving transistor DT during the reset segment RS, and a voltage difference between the first end e1 and the second end e2 of the storage capacitor Cst approaches the threshold voltage Vth of the driving transistor DT at the end of the compensating segment CS. During the data input segment DIS, the switching transistor 302 is disabled by the scan signal SC4, and the switching transistor 304 is disabled by the scan signal SC5, such that the reference voltage Vref is disallowed to be applied to the driving transistor DT, and a voltage difference between two ends of the delivery capacitor Cd is substantially equal to the data voltage Vdata. During the emission segment ES, the switching transistor 302 and the switching transistor 304 are disabled respectively by the scan signal SC4 and the scan signal SC5, such that the threshold voltage Vth of the driving transistor DT and the data voltage Vdata respectively stored in the storage capacitor Cst and the delivery capacitor Cd are applied to modulate the gate voltage of the driving transistor DT.

During the recovery segment RCS, one way to recover the threshold voltage shift of the driving transistor DT is as follows. The switching transistor 302 is enabled by the scan signal SC4 such that the reference voltage Vref with a voltage level lower than the sum of the voltage levels of the low-level voltage VSS, the threshold voltage Vth of the driving transistor DT, and the voltage difference between two ends of the light-emitting device 100 is applied to modulate the gate voltage of the driving transistor DT. Another way to recover the threshold voltage shift of the driving transistor DT is to use the data voltage Vdata instead of the reference voltage Vref. In such a case, the switching transistor 302 and the switching transistor 304 of the compensation circuit 300 are disabled such that the reference voltage Vref is disallowed to be applied to the second node N2, and the data voltage Vdata is disallowed to be applied to the first node N1.

It is noted that from FIGS. 2A to 2E the scan signals SC4 and SC5 are substantially the same. As a result, in order to save space for a circuit layout, the scan signals SC4 and SC5 can be the same scan signal. That is, the terminals C4 and C5 of the compensation circuit 300 (or the control terminal C6 of the switching transistor 302 and the control terminal C7 of the switching transistor 304, which are equivalent in the embodiments as illustrated by FIGS. 3A and 3C) can be electrically connected to the same scan line in some embodiments.

In some embodiments, the data circuit 400 includes a switching transistor 402 (referred to FIG. 3D). The switching transistor 402 has terminals T13 and T14 and a control terminal C5. The terminal T13 is electrically connected to the data voltage Vdata. The terminal T14 is electrically connected to the terminal T6 of the compensation circuit 300 and one end of the delivery capacitor Cd which is different from the end of the delivery capacitor Cd electrically connected to the low-level voltage VSS. The control terminal C5 is configured to receive the scan signal SC2. In some embodiments, the terminal T13 of the switching transistor 402 serves as the terminal T7 of the data circuit 400, the terminal T14 of the switching transistor 402 serves as the terminal T8 of the data circuit 400, and the control terminal C5 of the switching transistor 402 serves as the control terminal C2 of the data circuit 400. During the reset segment RS, the compensation segment CS, and the emission segment ES, the switching transistor 402 is disabled by the scan signal SC2. During the data input segment DIS, the switching transistor 402 is enabled by the scan signal SC2 to control the gate voltage of the driving transistor DT according to the data voltage Vdata. During the recovery segment RCS which uses the reference voltage Vref to recover the threshold voltage shift of the driving transistor DT, the switching transistor 402 is disabled by the scan signal SC2. During the recovery segment RCS which uses the data voltage Vdata to recover the threshold voltage shift of the driving transistor DT, the switching transistor 402 is enabled by the scan signal SC2, and the data voltage Vdata with a voltage level lower than the voltage level of the sum of the voltage level of the threshold voltage Vth of the driving transistor DT, the low-level voltage VSS, and the voltage difference between two ends of the light-emitting device 100 is applied to recover the threshold voltage shift of the driving transistor DT.

Figure 5:
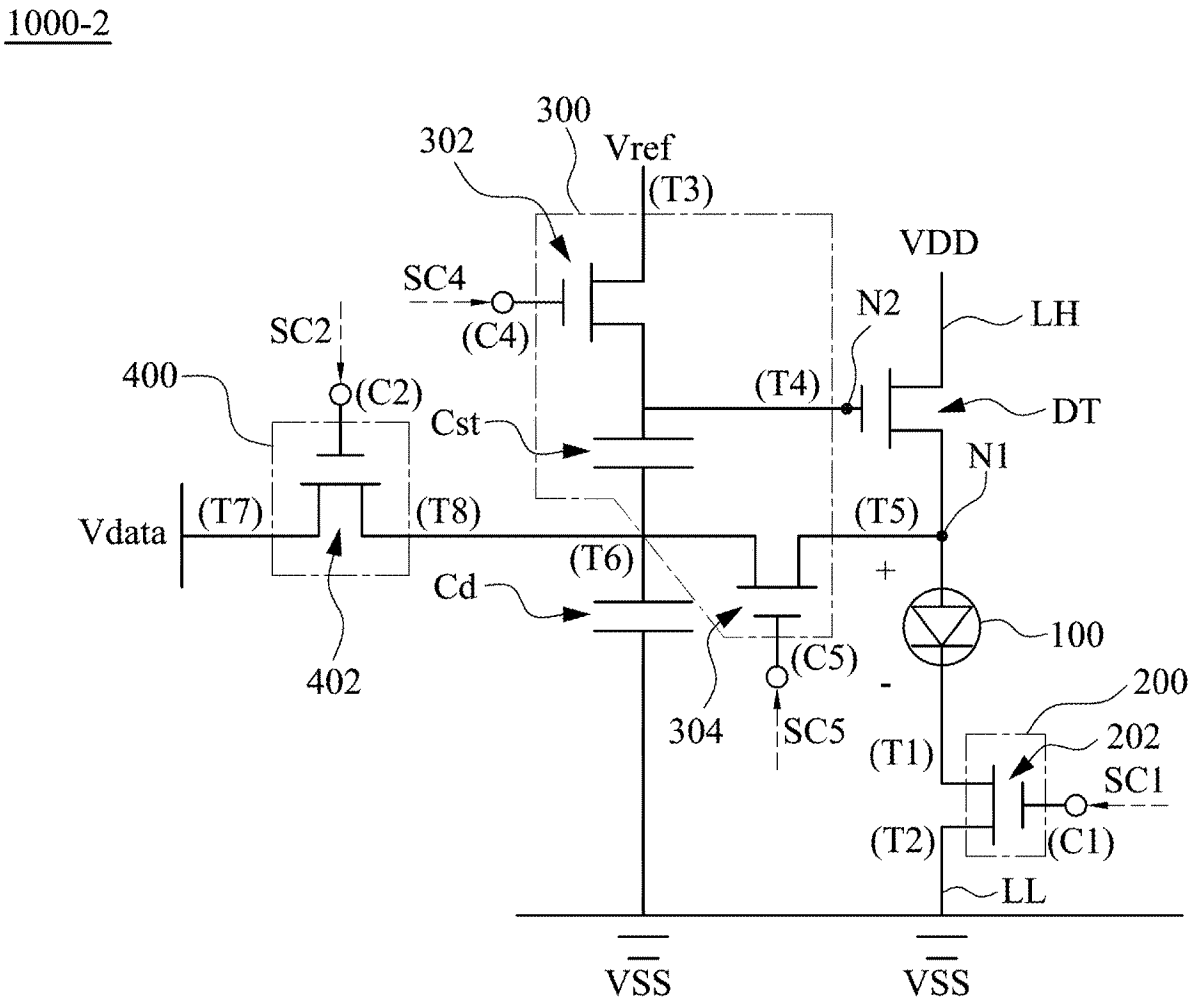
FIG. 5 is a schematic diagram of a light-emitting device driving circuit according to some embodiments of the present disclosure.

Reference is made to FIG. 5. FIG. 5 is a schematic diagram of a light-emitting device driving circuit 1000-2 according to some embodiments of the present disclosure. The difference between embodiments as illustrated by FIG. 5 and the embodiments as illustrated by FIG. 3A is that positions of the light-emitting device 100 and the reset circuit 200 in the circuit are exchanged. Therefore, a current provided by the driving transistor DT which is driven by the driving voltage VDD flows through the light-emitting device 100, the reset circuit 200, and the low-level voltage line LL in sequence in the embodiments as illustrated by FIG. 5.

Figure 6A:
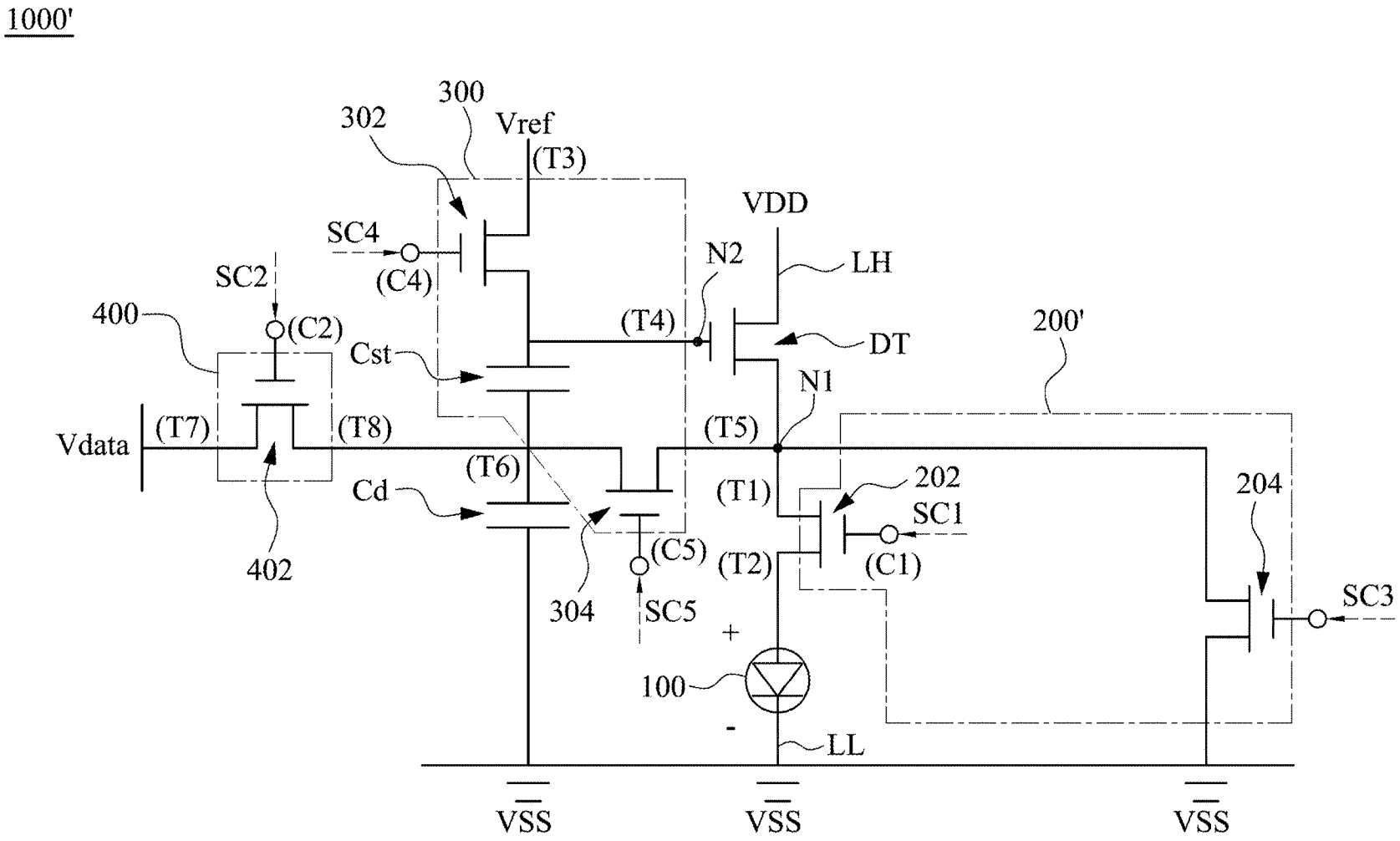
FIG. 6A is a schematic diagram of a light-emitting device driving circuit according to some embodiments of the present disclosure.
Figure 6B:
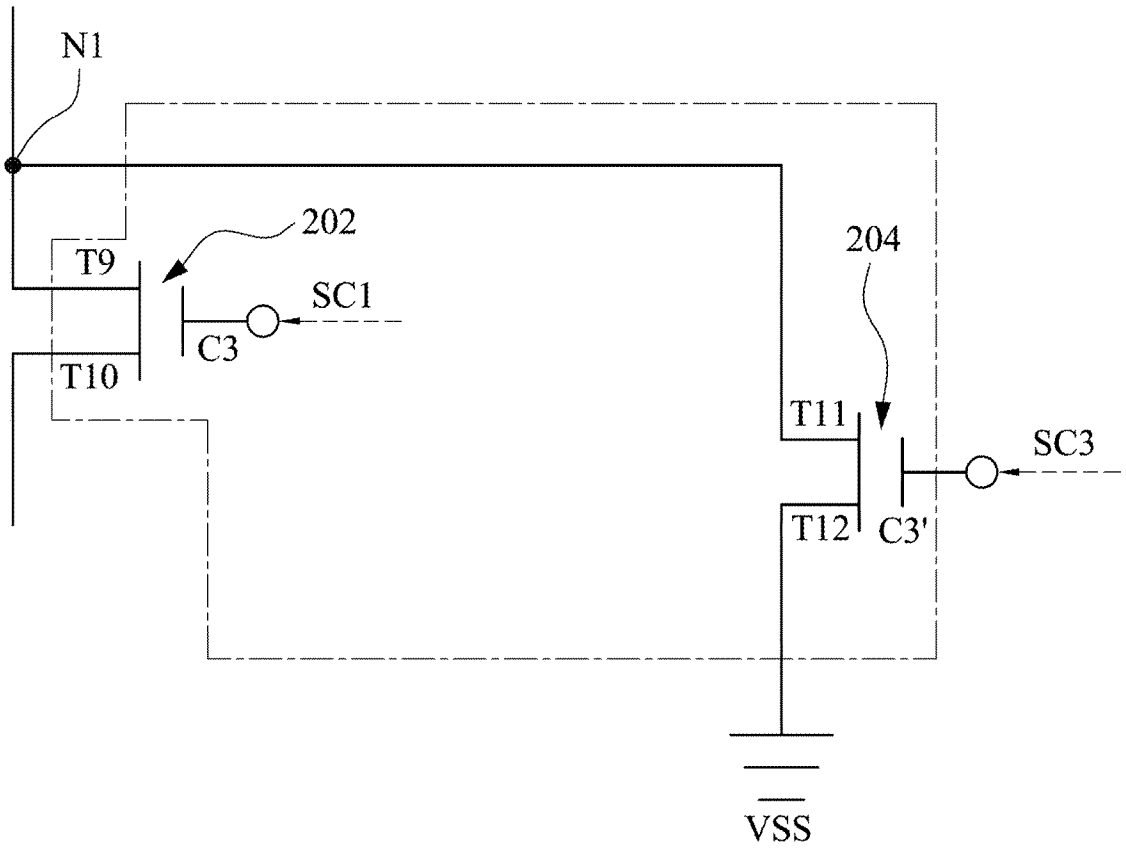
FIG. 6B is a schematic diagram of a reset circuit according to some embodiments of the present disclosure.
Figure 6C:
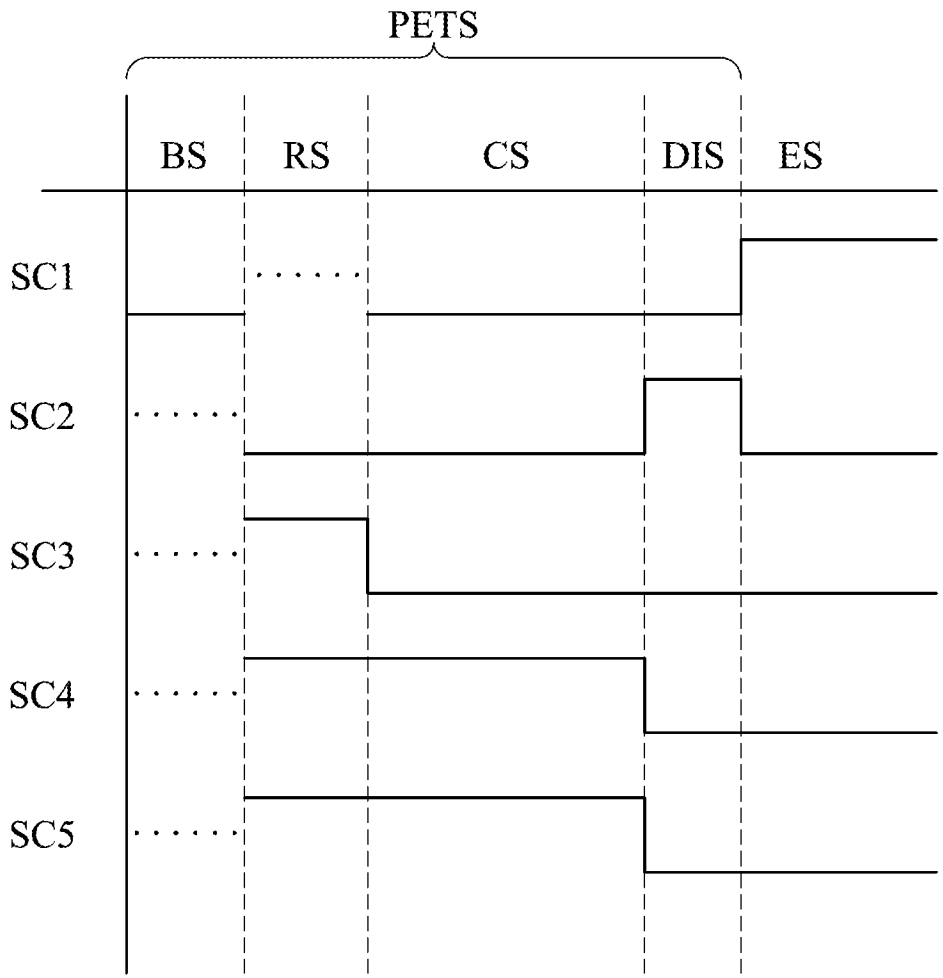
FIG. 6C is a timing diagram of an operation for the light-emitting device driving circuit according to some embodiments of the present disclosure.
Figure 7A:
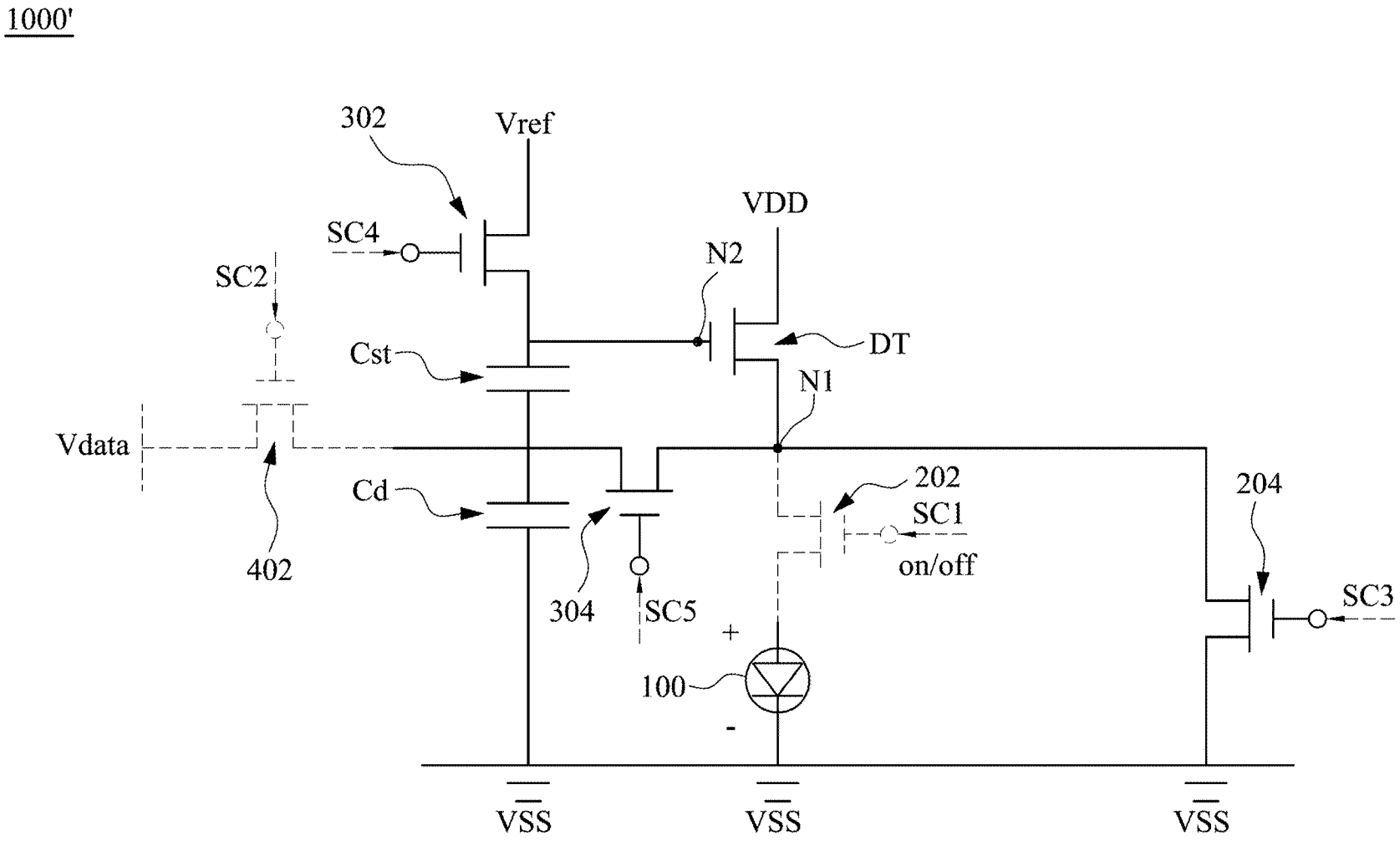
FIG. 7A is the light-emitting device driving circuit operated during the reset segment according to some embodiments of the present disclosure.
Figure 7B:
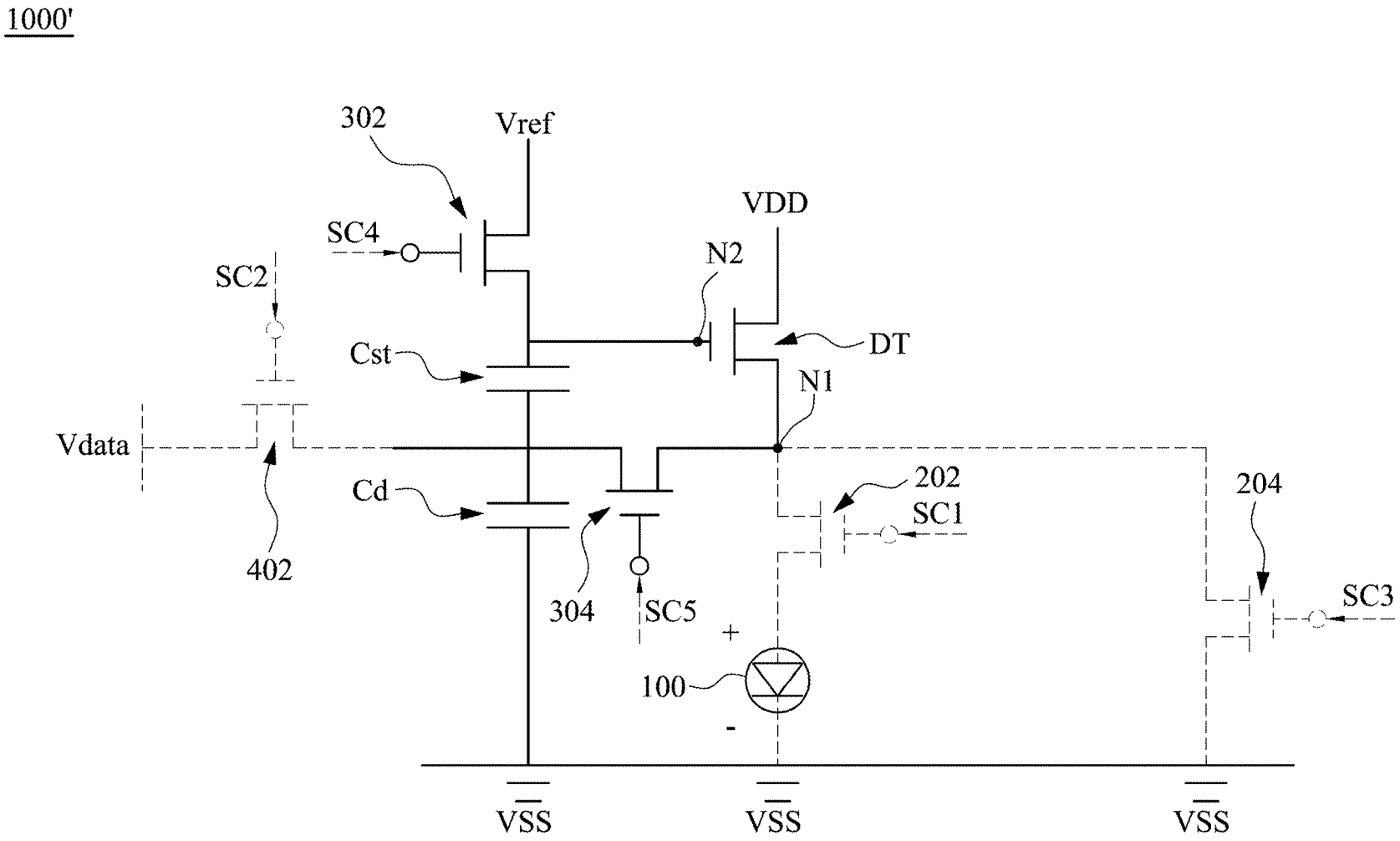
FIG. 7B is the light-emitting device driving circuit operated during the compensation segment according to some embodiments of the present disclosure.
Figure 7C:
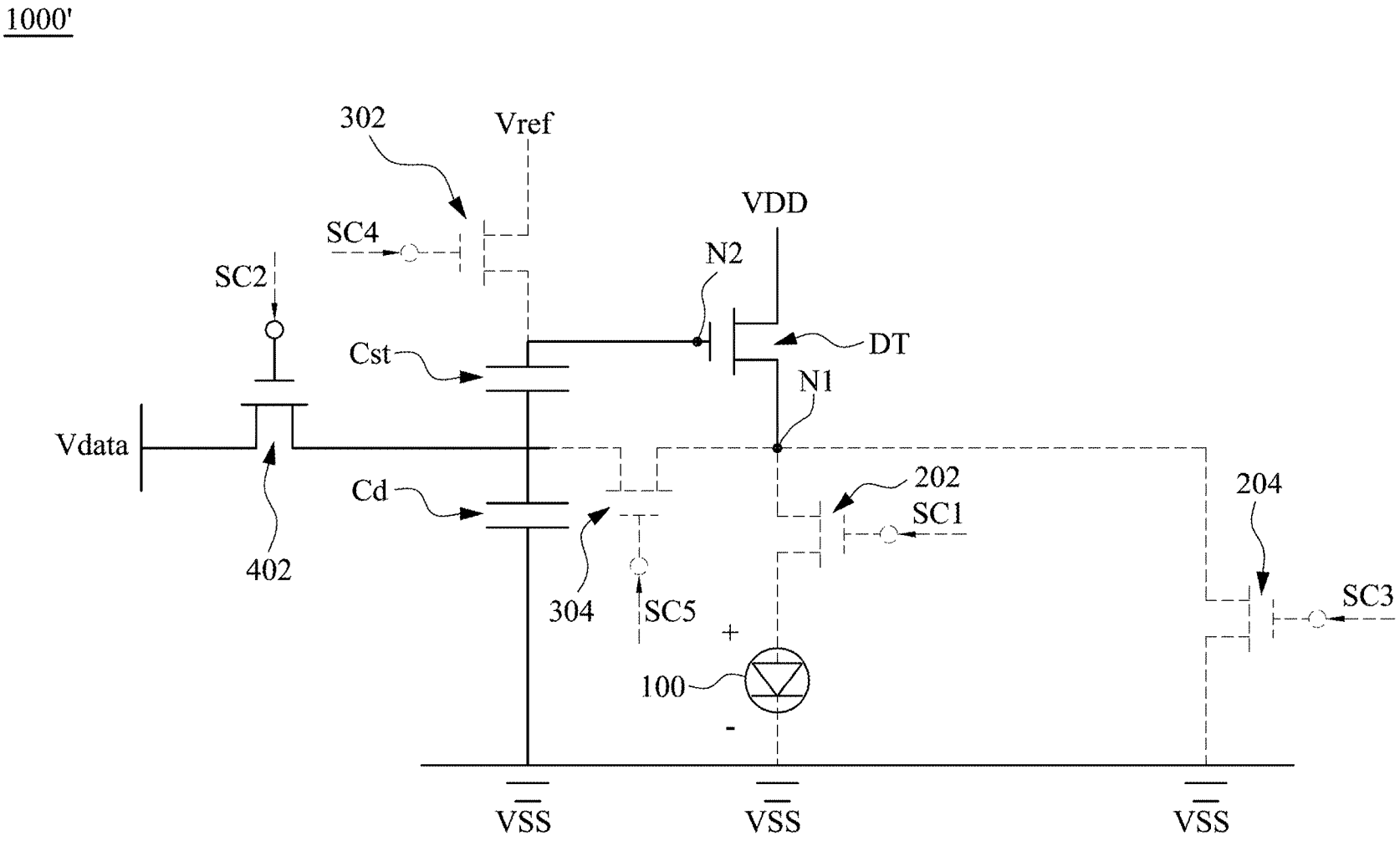
FIG. 7C is the light-emitting device driving circuit operated during the data input segment according to some embodiments of the present disclosure.
Figure 7D:
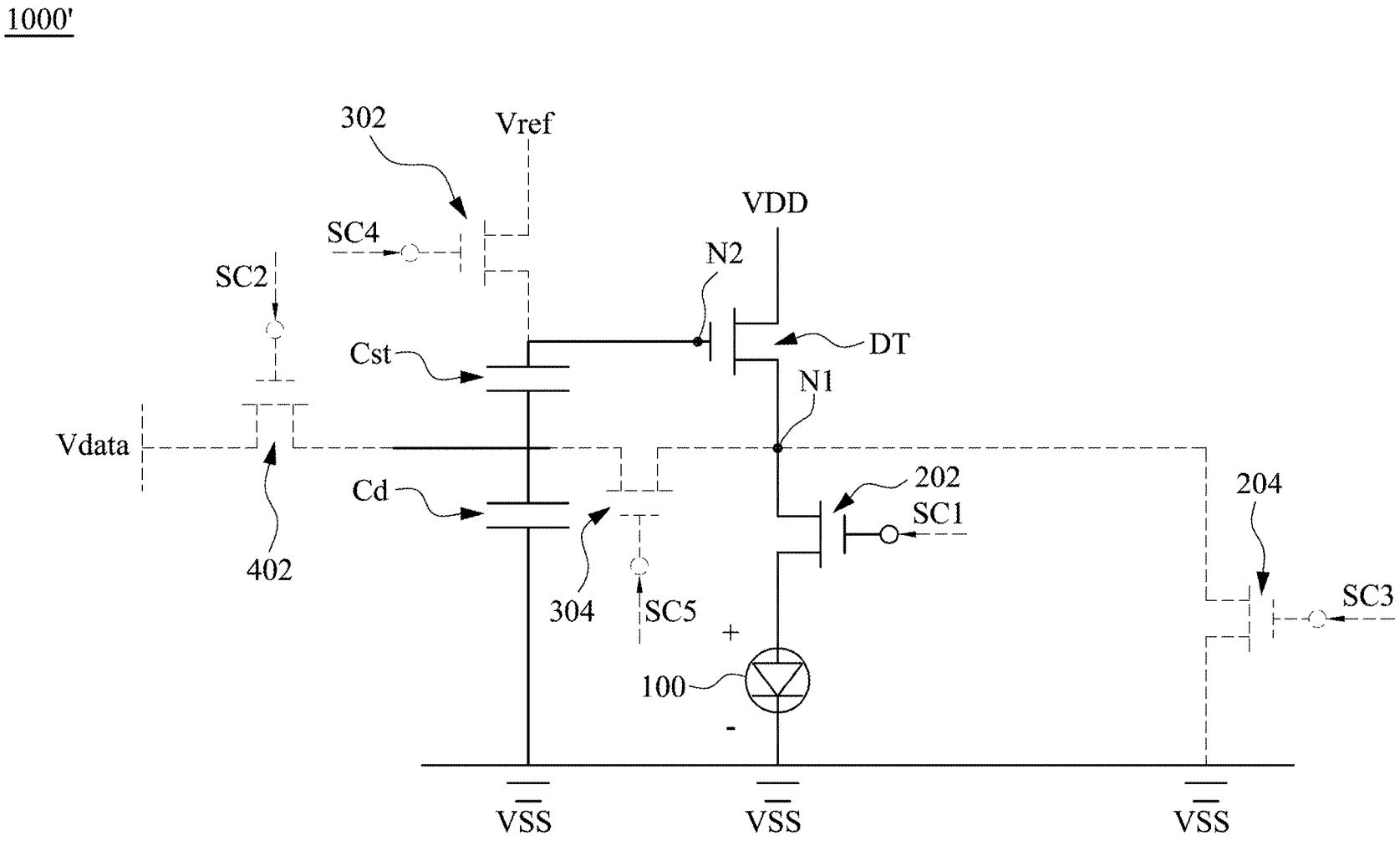
FIG. 7D is the light-emitting device driving circuit operated during the emission segment according to some embodiments of the present disclosure.

Reference is made to FIGS. 6A to 6C and FIGS. 7A to 7D. FIG. 6A is a schematic diagram of a light-emitting device driving circuit 1000' according to some embodiments of the present disclosure. FIG. 6B is a schematic diagram of a reset circuit 200' according to some embodiments of the present disclosure. FIG. 6C is a timing diagram of an operation for the light-emitting device driving circuit 1000' according to some embodiments of the present disclosure. FIG. 7A is the light-emitting device driving circuit 1000' operated during the reset segment RS according to some embodiments of the present disclosure. FIG. 7B is the light-emitting device driving circuit 1000' operated during the compensation segment CS according to some embodiments of the present disclosure. FIG. 7C is the light-emitting device driving circuit 1000' operated during the data input segment DIS according to some embodiments of the present disclosure. FIG. 7D is the light-emitting device driving circuit 1000' operated during the emission segment ES according to some embodiments of the present disclosure. A difference between embodiments as illustrated by FIG. 6A and the embodiments as illustrated by FIG. 3A is that a reset circuit 200' as shown in the embodiments illustrated by FIG. 6A further includes a switching transistor 204 compared to the reset circuit 200 as shown in the embodiments illustrated by FIG. 3A. The switching transistor 204 has terminals T11 and T12 and a control terminal C3'. The terminal T11 is electrically connected to the first node N1. The terminal T12 is electrically connected to the low-level voltage VSS. The control terminal C3' is configured to receive a scan signal SC3. During the reset segment RS, as illustrated by FIG. 7A, the switching transistor 204 is enabled by the scan signal SC3, such that a voltage level of the first node N1 is equal to the low-level voltage VSS. The switching transistor 202 can be enabled or disabled during the reset segment RS. During the compensation segment CS, as illustrated by FIG. 7B, the switching transistor 202 and the switching transistor 204 are disabled respectively by the scan signal SC1 and the scan signal SC3, such that the first node N1 is not electrically connected to the low-level voltage VSS. During the data input segment DIS, as illustrated by FIG. 7C, the switching transistor 204 is disabled by the scan signal SC3. During the emission segment ES, as illustrated by FIG. 7D, the switching transistor 202 is enabled by the scan signal SC1 and the switching transistor 204 is disabled by the scan signal SC3. During the recovery segment RCS which uses the reference voltage Vref to recover the threshold voltage shift of the driving transistor DT, the switching transistor 204 is enabled by the scan signal SC3, and during the recovery segment RCS which uses the data voltage Vdata to recover the threshold voltage shift of the driving transistor DT, the switching transistor 204 is also disabled by the scan signal SC3. It is noteworthy that in the embodiments illustrated by FIGS. 6A to 6C, a current do not flow through the light-emitting device 100 during the reset segment RS (and also the recovery segment RCS). Therefore, the voltage level of the reference voltage Vref applied during the reset segment RS shall be higher than a sum of the voltage levels of the threshold voltage Vth of the driving transistor DT and the low-level voltage VSS, and a voltage level of the reference voltage Vref applied during the recovery segment RCS shall be lower than the sum of the voltage levels of the threshold voltage Vth of the driving transistor DT and the low-level voltage VSS. Noted that the parameter "the voltage difference between two ends of the light-emitting device 100" is absent in the embodiments illustrated by FIGS. 6A to 6C.

Figure 8:
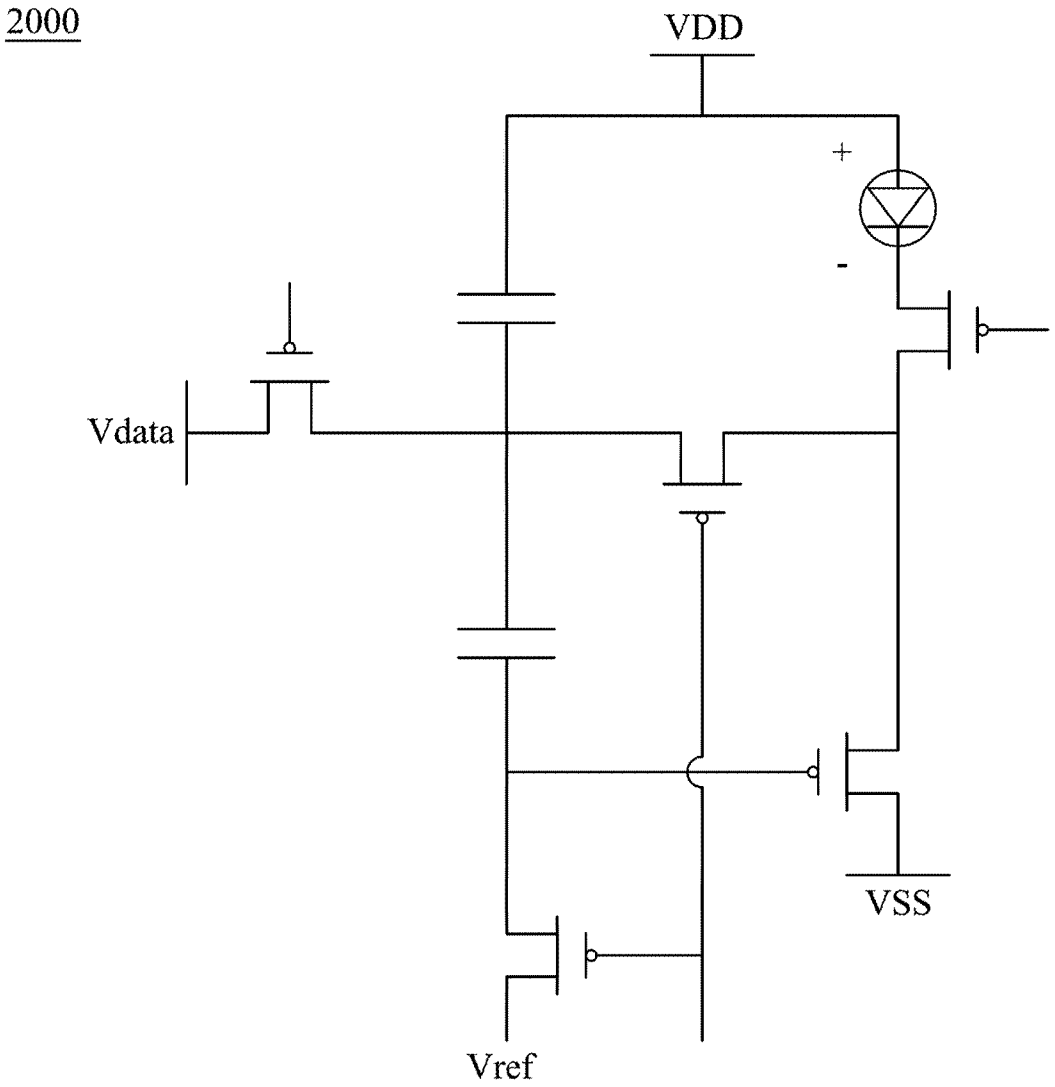
FIG. 8 is a schematic diagram of a light-emitting device driving circuit according to some embodiments of the present disclosure.

Reference is made to FIG. 8. FIG. 8 is a schematic diagram of a light-emitting device driving circuit 2000 according to some embodiments of the present disclosure. Transistors as shown in the embodiments illustrated by FIGS. 3A, 4A to 4D, 5, 6A, and 7A to 7D are n-channel transistors, such as a hydrogenated amorphous silicon (a-Si:H) transistor, an indium gallium zinc oxide (IGZO) transistor, or a n-type metal-oxide-semiconductor field effect transistor (NMOSFET). In some embodiments as illustrated by FIG. 8, the transistors are p-channel transistors, such as a low-temperature poly-silicon (LTPS) transistor. Similar to the embodiments illustrated by FIG. 3A and FIG. 5, positions of a light-emitting device and a reset circuit directly connected to the light-emitting device as shown in FIG. 8 can be exchanged in some other embodiments. The connection relations among electronic elements in the light-emitting device driving circuit 2000 as shown in FIG. 8 are substantially reversed as compared to the light-emitting device driving circuit 1000-1, 1000-2, and 1000' and will not be described herein in detail.

In summary, a light-emitting device driving circuit is provided to compensate a threshold voltage shift of a driving transistor used to drive a light-emitting device. In addition, a precision of controlling brightness in a low grayscale region of the light-emitting device is enhanced. Furthermore, a resolution of the light-emitting device driving circuit can be greatly enhanced since duration for waiting a compensation segment can be technically avoided within the scope of the light-emitting device driving circuit present in the embodiments of the present disclosure.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A light-emitting device driving circuit comprising:

a light-emitting device;

a delivery capacitor electrically connected to a low-level voltage;

a driving transistor configured to drive the light-emitting device according to a driving voltage received from a driving voltage line higher than the low-level voltage;

a reset circuit electrically connected to the driving transistor through a first node, electrically connected to the light-emitting diode, and configured to determine whether to allow a current to flow from the first node to the low-level voltage through the light-emitting device;

a compensation circuit electrically connected to the first node and the delivery capacitor and configured to receive a reference voltage higher than the low-level voltage and to control a gate voltage of the driving transistor through a second node; and a data circuit configured to receive a data voltage and to determine whether to electrically connect the data voltage to the compensation circuit and whether to electrically connect the data voltage to the delivery capacitor, wherein the light-emitting device driving circuit is operated in a pre-emission time segment and an emission time segment, wherein the pre-emission time segment does not overlap with the emission time segment, and the pre-emission time segment comprises a blank segment, a recovery segment, a reset segment, a compensation segment, a data input segment, or combinations thereof, and wherein during the emission segment, the data circuit and the compensation circuit are disabled and the reset circuit is enabled, such that the light-emitting device is driven according to the driving voltage and the gate voltage applied to the first driving transistor via the compensation circuit.

2. The light-emitting device driving circuit of claim 1, wherein the reset circuit comprises:

a first switching transistor having a first terminal electrically connected to the driving transistor through a first node, a second terminal electrically connected to the light-emitting device, and a control terminal configured to receive a first scan signal.

3. The light-emitting device driving circuit of claim 2, wherein during the reset segment and the emission segment, the first switching transistor is enabled by the first scan signal, and during the compensation segment, the first switching transistor is disabled by the first scan signal.

4. The light-emitting device driving circuit of claim 2, wherein the reset circuit further comprises:

a second switching transistor having a first terminal electrically connected to the first node, a second terminal electrically connected to the low-level voltage, and a control terminal configured to receive the second scan signal.

5. The light-emitting device driving circuit of claim 4, wherein during the reset segment, the second switching transistor is enabled by the second scan signal, during the compensation segment, the first switching transistor and the second switching transistor are disabled respectively by the first scan signal and the second scan signal, during the data input segment, the second switching transistor is disabled by the second scan signal, and during the emission segment, the first switching transistor is enabled by the first scan signal and the second switching transistor is disabled by the second scan signal.

6. The light-emitting device driving circuit of claim 4, wherein during the recovery segment, the second switching transistor is enabled by the second scan signal.

7. The light-emitting device driving circuit of claim 1, wherein the compensation circuit comprises:

a storage capacitor having a first end and a second end;

a third switching transistor having a first terminal electrically connected to the reference voltage, a second terminal electrically connected to the first end of the storage capacitor and a second node, and a control terminal configured to receive a third scan signal; and a fourth switching transistor having a first terminal electrically connected to the second end of the storage capacitor and the delivery capacitor, a second terminal electrically connected to the first node, and a control terminal configured to receive a fourth scan signal.

8. The light-emitting device driving circuit of claim 7, wherein during the reset segment and the compensation segment, the third switching transistor and the fourth switching transistor are enabled respectively by the third scan signal and the fourth scan signal, during the data input segment, the third switching transistor is disabled by the third scan signal; and during the emission segment, the third switching transistor and the fourth switching transistor are disabled respectively by the third scan signal and the fourth scan signal.

9. The light-emitting device driving circuit of claim 8, wherein the third scan signal and the fourth scan signal are the same scan signal.

10. The light-emitting device driving circuit of claim 1, wherein the data circuit comprises:

a fifth switching transistor having a first terminal electrically connected to the data voltage, a second terminal electrically connected to the compensation circuit and the delivery capacitor, and a control terminal configured to receive the fifth scan signal.

11. The light-emitting device driving circuit of claim 10, wherein during the reset segment, the compensation segment, and the emission segment, the fifth switching transistor is disabled by the fifth scan signal, and during the data input segment, the fifth switching transistor is enabled by the fifth scan signal.

12. The light-emitting device driving circuit of claim 1, wherein during the reset segment, the data circuit is disabled and the reset circuit and the compensation circuit are enabled, such that the data voltage is not applied to the driving transistor and a voltage difference between the second node and the first node is greater than a threshold voltage of the driving transistor.

13. The light-emitting device driving circuit of claim 1, wherein during the compensation segment, the data circuit and the reset circuit are disabled and the compensation circuit is enabled, such that a voltage level of the first node is gradually increased until a voltage difference between the second node and the first node approaches a threshold voltage of the driving transistor.

14. The light-emitting device driving circuit of claim 1, wherein during the data input segment, the reset circuit and the compensation circuit are disabled and the data circuit is enabled, such that the data voltage and a threshold voltage of the driving transistor are combined and applied to the driving transistor through the delivery capacitor and the compensation circuit.

15. The light-emitting device driving circuit of claim 1, wherein during the recovery segment, the reference voltage or the data voltage having a voltage level lower than a sum of voltage levels of the low-level voltage, a threshold voltage of the driving transistor, and a voltage difference between two ends of the light-emitting device is applied to control the gate voltage of the driving transistor, such that a threshold voltage shift of the driving transistor during the emission segment is recovered.

* * * * *